US006312885B1

(12) United States Patent
Fujita et al.

(10) Patent No.: US 6,312,885 B1
(45) Date of Patent: Nov. 6, 2001

(54) PHOTOTHERMO-OR THERMO-GRAPHIC MATERIAL

(75) Inventors: Munehisa Fujita; Ichizo Toya, both of Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/531,421

(22) Filed: Mar. 20, 2000

(30) Foreign Application Priority Data

Mar. 30, 1999 (JP) ..... 11-090223

(51) Int. Cl.[7] ..... G03C 1/498; G03C 1/76

(52) U.S. Cl. ..... 430/617; 430/523; 430/531; 430/619

(58) Field of Search ..... 430/617, 619, 430/523, 531, 203

(56) References Cited

U.S. PATENT DOCUMENTS 3,933,508 * 1/1976 Ohkubo et al. .
5,536,627 * 7/1996 Wang et al. ..... 430/523
6,140,038 * 10/2000 Ishizuka et al. ..... 430/619

* cited by examiner

*Primary Examiner*—Thorl Chea
(74) *Attorney, Agent, or Firm*—Birch, Stewart, Kolasch & Birch, LLP

(57) ABSTRACT

A photothermographic or thermographic material comprising a support having provided thereon or thereabove at least one image forming layer having its thermal expansion coefficient in the range of 1.0 to 1.5 and having provided on or above said at least one image forming layer a layer which has its thermal expansion coefficient of at least 0.9 and lower than 1.0 and comprises at least one kind of polymer latex having a glass transition temperature of not higher than a heat development temperature, said layer which has its thermal expansion coefficient of at least 0.9 and lower than 1.0 being farther from the support than the at least one image forming layer.

12 Claims, 1 Drawing Sheet

PHOTOTHERMO-OR THERMO-GRAPHIC MATERIAL

FIELD OF THE INVENTION

The present invention relates to photothermographic or thermographic materials. Of the materials, the chief concern of the invention is a photothermographic material, particularly a photothermographic material which is inhibited from cracking upon heat development.

BACKGROUND OF THE INVENTION

Photothermographic materials have been proposed from of old. For instance, such materials are disclosed in U.S. Pat. Nos. 3,152,904 and 3,457,075, and *Thermally Processed Silver Systems* written by D. Klosterboer in the book entitled "Imaging Processes and Materials", 8th ed., §9th, p 279, compiled by J. Sturge, V. Walworth & A, Shepp, published by Neblette in 1989. In general a photothermographic material has a photosensitive layer containing in a binder matrix a catalytic amount of photocatalyst (e.g., silver halide), a reducing agent, a reducible silver salt (e.g., an organic silver salt) and, if needed, a toning agent for controlling the tone of silver. After imagewise exposure, the photothermographic material is heated at a high temperature (e.g., at least 80° C.) to cause a redox reaction between silver halide or a reducible silver salt (functioning as an oxidizing agent), thereby forming a black silver image. The redox reaction is accelerated by the catalytic action of a latent image formed from the silver halide by exposure. Accordingly, the black silver image is formed in the exposed area.

The photosensitive layer of a photothermographic material has so far been formed using a coating solution containing polyvinyl butyral (PVB) as a binder in an organic solvent. However, the use of an aqueous solvent for the coating solution has been desired from the working viewpoint of preparation and application of a coating solution and the instrumental viewpoint. As a solution to such a problem, the method of coating an aqueous dispersion of styrene-butadiene copolymer for the formation of a photosensitive layer has been proposed in, e.g., JP-A-10-186567 (the term "JP-A" as used herein means an "unexamined published Japanese patent application"). However, the protective layer made of gelatin has turned out to crack when it was provided on the photosensitive layer using the foregoing styrene-butadiene copolymer as binder and underwent heat development. This cracking problem is not produced in the case where the protective layer made of gelatin, cellulose or the like is provided on the photosensitive layer using PVB as binder.

SUMMARY OF THE INVENTION

An object of the present invention is to provide photothermographic or thermographic materials, particularly a photothermographic material, which are prevented from causing cracks upon heat development.

The aforementioned object of the present invention is attained by the following Embodiments (1) to (8):

(1) A photothermographic or thermographic material comprising a support having provided thereon or thereabove at least one image forming layer having its thermal expansion coefficient in the range of 1.0 to 1.5 and having provided on or above said at least one image forming layer a layer which has its thermal expansion coefficient of at least 0.9 and lower than 1.0 and comprises at least one kind of latex of polymer having a glass transition temperature of not higher than a heat development temperature, said layer which has its thermal expansion coefficient of at least 0.9 and lower than 1.0 being farther from the support than the at least one image forming layer.

(2) A photothermographic or thermographic material according to Embodiment (1), wherein the layer having its thermal expansion coefficient of at least 0.9 and lower than 1.0 is a surface protective layer.

(3) A photothermographic or thermographic material according to Embodiment (1) or (2), wherein the heat development temperature is from 90° C. to 130° C.

(4) A photothermographic or thermographic material according to Embodiment (1), (2) or (3), wherein the polymer comprises repeating units derived from ethylenically unsaturated monomeric units containing an active methylene group and monomeric units containing at least two ethylenically unsaturated groups per unit.

(5) A photothermographic or thermographic material according to Embodiment (4), wherein the ethylenically unsaturated monomeric units containing an active methylene group are represented by formula (I):

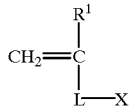

(I)

wherein $R^1$ represents a hydrogen atom, an alkyl group containing 1 to 4 carbon atoms or a halogen atom, L represents a single bond or a divalent linkage group, X represents an active methylene group selected from $R^2COCH_2COO$—, NC—$CH_2COO$—, $R^2COCH_2CO$—, NC—$CH_2CO$— or $R^9$—CO—$CH_2CON(R^6)$—, $R^2$ represents an alky group containing 1 to 12 carbon atoms, an aryl group containing 6 to 20 carbon atoms, an alkoxy group containing 1 to 12 carbon atoms, an amino group or a substituted amino group containing 1 to 12 carbon atoms, $R^6$ represents a hydrogen atom or an alkyl group containing 1 to 6 carbon atoms, and $R^9$ represents a primary or secondary alkyl group containing 1 to 12 carbon atoms, an alkoxy group containing 1 to 12 carbon atoms, an amino group or a substituted amino group containing 1 to 12 carbon atoms, wherein the divalent linkage group as L is bonded to X in the form of an alkylene, aralkylene or arylene moiety thereof.

(6) A photothermographic or thermographic material according to any of Embodiments (1) to (5), wherein the image forming layer contains at least an organic silver salt and a reducing agent.

(7) A photothermographic or thermographic material according to any of Embodiments (1) to (6), wherein the image forming layer comprises a photosensitive silver salt.

(8) A photothermographic or thermographic material according to any of Embodiments (1) to (7), wherein the image forming layer comprises a binder having an equilibrium moisture content of at most 2 weight % under a condition of 25° C.–60% RH in a proportion of at least 50 weight % to the total binders contained therein.

Figure 1:
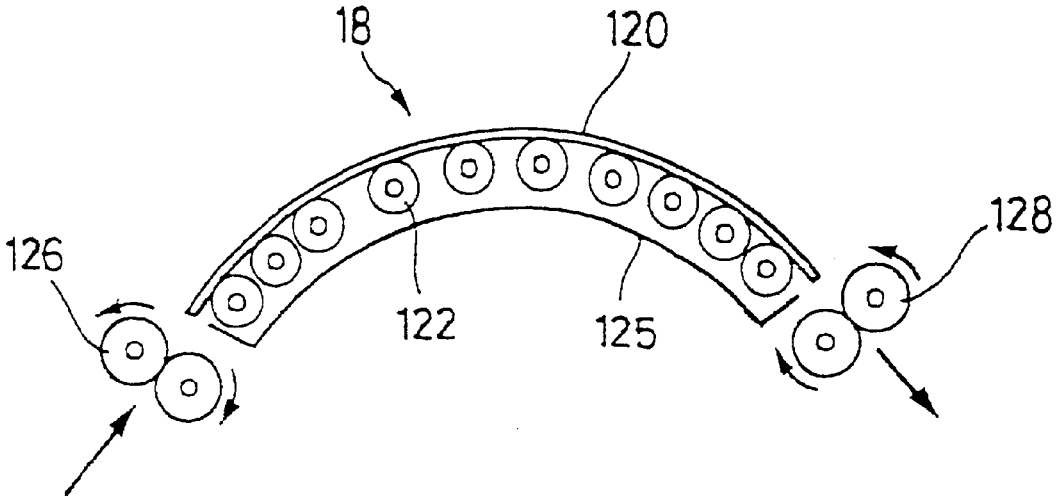
FIG. 1 is a schematic cross-sectional view of the heat development section adopting a plate heater system.

The numbers used therein refer to the following;

18: Heat development section
120: Plate heater
122: Pressing roller
125: Heat-retention cover
126: Feeding rollers
128: Discharging rollers
130: Driving roller

DETAILED DESCRIPTION OF THE INVENTION

The present invention is illustrated below in more detail.

The photothermographic or thermographic material according to the invention has, on a support, constituent layers including at least one image forming layer which comprises an organic silver salt and a binder. In such an image forming layer, it is desirable that a reducing agent is further contained. Moreover, it is more preferable that a photothermographic material comprises a photosensitive layer containing photosensitive silver halide as a photosensitive silver salt. The most desirable photothermographic material is a material having a photosensitive layer as the image forming layer, and it is desirable for the photosensitive layer to contain photosensitive silver halide, an organic silver salt, a reducing agent for silver ion and a binder. In the image forming layer, particularly preferably the photosensitive layer, of such a photothermographic material, it is desirable to use as a main binder (which comprises at least 50 weight % of the total binders) a polymer enabling the preparation of an aqueous coating solution the solvent of which contains water in a proportion of at least 30 weight %, which is said to be favorable from the environmental viewpoint, and having an equilibrium moisture content of at most 2 weight % under a condition of 25° C.–60% RH, which is said to be favorable for obtaining excellent photographic performance.

In the photothermographic or thermographic material mentioned above, at least one image forming layer has a thermal expansion coefficient of at least 1.0 and at most 1.5, and at least one layer (e.g., an interlayer, a protective layer) provided on the upper side of the image forming layer has a thermal expansion coefficient of at least 0.9 and lower than 1.0. Further, the latter layer uses as a part of its binders a latex of polymer having a glass transition temperature (Tg) of not higher than a heat development temperature, thereby preventing the cracks caused by heat development. By contrast, cracks appear unless the polymer latex is used for an upper layer of the image forming layer. And the similar phenomenon is produced if the polymer latex has Tg higher than a heat development temperature.

The thermal expansion coefficient is represented by the following equation, and measured in the following way:

Thermal expansion coefficient=sample length at 100° C.÷sample length at 30° C.

On a Teflon base, a coating solution for each of the desired layers is coated in a layer so as to have a dry thickness of 25 μm. The coated layer is dried at 30° C., and then peeled away from the base to prepare a monolayer film.

Then, the monolayer film is examined for thermal expansion coefficients from 30° C. to 100° C. in an atmosphere of dried nitrogen by means of a thermal expansion coefficient measuring apparatus, Thermomechanical Analyzer TMA 2940 (made by TMA Instruments Inc.).

The layers having specified thermal expansion coefficients are illustrated below. As mentioned above, the thermal expansion coefficient is defined as a ratio of length at 100° C./length at 30° C.

Examples of a binder which can form a layer having a thermal expansion coefficient in the range of 1.0 to 1.5 include hydrophobic polymers, such as acryl resin, polyester resin, rubber resin (e.g., SBR resin), polyurethane resin, vinyl chloride resin, vinyl acetate resin, vinylidene chloride resin and polyolefin resin, and copolymers of different monomers constituting the hydrophobic polymers as described above. The polymer latexes are described in, e.g., the book entitled "Gosei Jushi Emulsions" (which means "Synthetic Resin Emulsions"), compiled by Taira Okuda & Hiroshi Inagaki, published by Kobunshi Kankokai (1978), the book entitled "Gosei Latexes no Ohyo" (which means "Applications of Synthetic Latexes"), compiled by Takaaki Sugimura, Yasuo Kataoka, Souichi Suzuki & Keiji Ogasawara, published by Kobunshi Kankokai (1993), and the book entitled "Gosei Latexes no Kagaku" (which means "Chemistry of Synthetic Latexes"), written by Sohichi Muroi, published by Kobunshi Kankokai (1970).

The polymers as the foregoing binder may be straight-chain, branched or cross-linked polymers. And they may be homopolymers prepared by polymerizing the same kind of monomers, or copolymers prepared by polymerizing at least two different kinds of monomers. In the case of copolymers, they maybe random copolymers, or block copolymers. The suitable number average molecular weight of the polymers is from 5,000 to 1,000,000, preferably from 10,000 to 200,000. When the molecular weight of a polymer used has too low, the emulsion layer formed is insufficient in mechanical strength; while, when it is too high, the polymer is inferior in film-forming properties.

In using those polymers as the binder which can form the present layer having a thermal expansion coefficient in the range of 1.0 to 1.5, it is desirable to disperse them into aqueous dispersing media. The term "aqueous dispersing media" as used herein refers to the dispersing media wherein water is contained in a proportion of at least 30 weight %. As to the dispersed condition of a polymer in such a dispersing medium, the polymer may be dispersed in any condition, specifically an emulsified condition, a micellar condition, or a molecular condition if it has hydrophilic moieties. Of these conditions, the latex condition is preferred over the others.

The image forming layer having a thermal expansion coefficient of from 1.0 to 1.5 can be obtained by the use of the binder as mentioned above. Such a binder may be mixed with gelatin, polyvinyl alcohol (PVA) or/and the like, provided that the layer formed therefrom can have its thermal expansion coefficient in the range of 1.0 to 1.5. The thermal expansion coefficient of the image forming layer is preferably from 1.1 to 1.3. Such an image forming layer is illustrated hereinafter.

As examples of a binder which can form a layer having a thermal expansion coefficient of at least 0.9 and lower than 1.0, on the other hand, mention may be made of gelatin (thermal expansion coefficient: 0.93), polyvinyl alcohol (PVA) (thermal expansion coefficient: 0.988) and polyvinyl butyral (PVB) (thermal expansion coefficient: 0.995). As such a binder, hydrophilic polymers having a thermal expansion coefficient of at least 0.9 and lower than 1.0, particularly at least 0.9 and not higher than 0.95, are preferred. Of these hydrophilic polymers, gelatin is most favorable.

Examples of a polymer latex which can be suitably used as a binder for the layer having a thermal expansion coefficient of at least 0.9 and lower than 1.0 in the invention include the following latexes, which are expressed with the starting monomers for their individual syntheses. Therein, each numerical value in parentheses is the fraction of the corresponding monomer, expressed in weight %, and the glass transition temperature (Tg) of each latex is shown in brackets.

E-1: Latex of -MMA(92)-AA(4)-NMAM(4)-[Tg=107° C.]
E-2: Latex of -EA(100)-[Tg=−24° C.]
E-3: Latex of -MMA(70)-EA(27)-AA(3)-[Tg=59° C.]
E-4: Latex of -MMA(70)-2EHA(20)-St(5)-AA(5)-[Tg=59° C.]
E-5: Latex of -St(50)-Bu(47)-MAA(3)-[Tg=−17° C.]
E-6: Latex of -St(68)-Bu(29)-AA(3)-[Tg=17° C.]
E-7: Latex of -St(70)-Bu(27)-IA(3)-[Tg=15° C.]
E-8: Latex of -St(75)-Bu(24)-AA(1)-[Tg=26° C.]
E-9: Latex of -St(60)-Bu(35)-DVB(3)-MAA(2)-[Tg=−1° C.]
E-10: Latex of -St(70)-Bu(25)-DVB(2)-AA(3)-[Tg=22° C.]
E-11: Latex of -VC(50)-MAA(20)-EA(20)-AN(5)-AA(5)-[Tg=60° C.]
E-12: Latex of -VDC(85)-MMA(5)-EA(5)-MAA(5)-[Tg=−7° C.]
E-13: Latex of -Et(90)-MMA(10)-[Tg=−114° C.]
E-14: Latex of -St(70)-2EHA(27)-AA(3)-[Tg=43° C.]
E-25: Latex of -MMA(63)-EA(35)-AA(2)-[Tg=47° C.]

The abbreviations of monomers in the foregoing structures are as follows: MMA, methyl methacrylate; EA, ethyl acrylate; MAA, methacrylic acid; 2EHA, 2-ethylhexyl acrylate; St, styrene; Bu, butadiene; AA, acrylic acid; DVB, divinylbenzene; VC, vinyl chloride; AN, acrylonitrile; VDC, vinylidene chloride; Et, ethylene; IA, itaconic acid; NMAM, N-methylolacrylamide.

The polymers described above are on the market today, and the following products are available. Examples of commercial acrylic resin include Sebian A-4635, 46583 and 4601 (produced by Daicell Chemical Industry K.K.) and Nipol Lx811, 814, 821, 820 and 857 (produced by Nippon Zeon K.K.) Examples of commercial polyester resin include FINETEX ES650, 611, 675 and 850 (produced by Dai-Nippon Ink & Chemicals, Inc.), and WD-size and WMS (produced by Eastman Chemical Products, Inc.). Examples of commercial polyurethane resin include HYDRAN AP10, 20, 30 and 40 (produced by Dai-Nippon Ink & Chemicals, Inc.). Examples of commercial rubber resin include LACSTAR 7310K, 3307B, 4700H and 7132C (produced by Dai-Nippon Ink & Chemicals, Inc.), and Nipol Lx416, 410, 438C and 2507 (produced by Nippon Zeon K.K.). Examples of commercial vinyl chloride resin include G351 and G576 (produced by Nippon Zeon K.K.), those of commercial vinylidene chloride resin include L502 and L513 (produced by Asahi Chemical Industry Co., Ltd.), and those of commercial olefin resin include Chemipearl S120 and SA100 (produced by Mitsui Petrochemical Industries, Ltd.).

Those polymer latexes may be used individually, or two or more of them may be blended together, if needed.

When the latex of polymer comprising constitutional repeating units derived from ethylenically unsaturated monomeric units containing an active methylene group and monomeric units containing at least two ethylenically unsaturated groups per unit is used in the layer having a thermal expansion coefficient of at least 0.9 and lower than 1.0, desirable results can be obtained in the invention.

The repeating units derived from an ethylenically unsaturated monomer containing an active methylene group represented by the following formula (I), which are comprised in a polymer latex desirably used in the invention, are illustrated below in more detail:

(I)

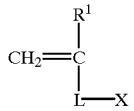

In the above formula, $R^1$ represents a hydrogen atom, an alkyl group containing 1 to 4 carbon atoms (e.g., methyl, ethyl, n-propyl, n-butyl) or a halogen atom (e.g., chlorine, bromine) preferably a hydrogen atom, a methyl group or a chlorine atom. L represents a single bond, or a divalent linkage group which is specifically represented by the following formula;

$$-(L^1)_m-(L^2)_n-$$

wherein $L^1$ represents —CON($R^3$)— (wherein $R^3$ represents a hydrogen atom, an unsubstituted alkyl group containing 1 to 4 carbon atoms, or a substituted alkyl group containing 1 to 6 carbon atoms), —COO—, —NHCO—, —OCO—,

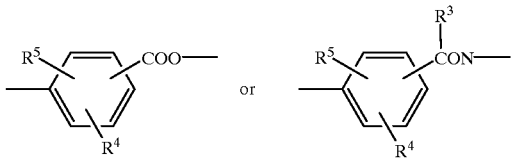

(wherein $R^4$ and $R^5$ are independent of each other, and each of them represents a hydrogen atom, a hydroxyl group, a halogen atom, or an unsubstituted or substituted alkyl, alkoxy, acyloxy or aryloxy group, $R^3$ has the same meaning as the above); $L^2$ is a linkage group through which $L^1$ is linked to X; and m represents 0 or 1 and n represents 0 or 1, provided that m is 0 in the case of n=0.

Specifically, the linkage group represented by $L^2$ is represented by the following formula:

$$-X^1-(J^1-X^2)_p-(J^2-X^3)_q-(J^3-X^4)_r-$$

In the above formula, $J^1$, $J^2$ and $J^3$, which may be the same or different, each represent —CO—, —$SO_2$—, —CON($R^6$)— [wherein $R^6$represents a hydrogen atom, an unsubstituted $C_{1-6}$ alkyl group or a substituted $C_{1-6}$ alkyl group], —$SO_2$N($R^6$)— [wherein $R^6$ has the same meaning as the above], —N($R^6$)—$R^7$— [wherein $R^6$ has the same meaning as the above, and $R^7$ represents an alkylene group containing 1 to 4 carbon atoms], —N($R^6$)—$R^7$—N ($R^8$)— [wherein $R^6$ and $R^7$have the same meanings as the foregoing ones respectively, and $R^8$ represents a hydrogen atom, an unsubstituted $C_{1-6}$ alkyl group or a substituted $C_{1-6}$ alkyl group], —O—, —S—, —N($R^6$)—CO—N($R^8$)— [wherein $R^6$ and $R^8$ have the same meaning as the foregoing ones respectively], —N($R^6$)—$SO_2$—N ($R^8$)— [wherein $R^6$ and $R^8$ have the same meaning as the foregoing ones respectively], —COO—, —OCO—, —N($R^6$)$CO_2$— [wherein $R^6$has the same meaning as the above] or —N($R^6$)CO— [wherein $R^6$ has the same meaning as the above].

p, q and r each represent 0 or 1. $X^1$, $X^2$, $X^3$ and $X^4$, which may be the same or different, each represent an unsubstituted or substituted alkylene group containing 1 to 10 carbon atoms, an aralkylene group containing 7 to 20 carbon atoms, or an arylene group containing 6 to 20 carbon atoms. The alkylene group may have a straight-chain or branched form. Examples of such an alkylene group include methylene, methylmethylene, dimethylmethylene, methoxymethylene, dimethylene, trimethylene, tetramethylene, pentamethylene, hexamethylene and decylmethylene groups. An example of such an aralkylene group is a benzylidene group, and examples of such an arylene group include p-phenylene, m-phenylene, methylphenylene and chlorophenylene groups.

X is a univalent group containing an active methylene group, with examples including $R^2COCH_2COO$—, $NCCH_2COO$—, $R^2COCH_2CO$—, NC—$CH_2CO$— and $R^9$—CO—$CH_2CON(R^6)$—. Herein, $R^6$ represents a hydrogen atom or an alkyl group containing 1 to 6 carbon atoms, $R^2$ represents a substituted or unsubstituted alkyl group containing 1 to 12 carbon atoms (e.g., methyl, ethyl, n-propyl, n-butyl, t-butyl, n-nonyl, 2-methoxyethyl, 4-phenoxybutyl, benzyl, 2-methanesulfonamidoethyl), a substituted or unsubstituted aryl group containing 6 to 20 carbon atoms (e.g., phenyl, p-methylphenyl, p-methoxyphenyl, o-chlorophenyl), an alkoxy group containing 1 to 12 carbon atoms (e.g., methoxy, ethoxy, methoxyethoxy, n-butoxy), a cycloalkyloxy group (e.g., cyclohexyloxy), an aryloxy group (e.g., phenoxy, p-methylphenoxy, o-chlorophenoxy, p-cyanophenoxy), an amino group, or a substituted amino group containing 1 to 12 carbon atoms (e.g., methylamino, ethylamino, dimethylamino, butylamino). Of the groups described above, substituted or unsubstituted primary and secondary alkyl groups containing 1 to 12 carbon atoms are preferred over the others. $R^9$ represents a substituted or unsubstituted primary or secondary alkyl group containing 1 to 12 carbon atoms, an alkoxy group containing 1 to 12 carbon atoms, an amino group or a substituted amino group containing 1 to 12 carbon atoms. Examples of each group include the same ones as in the description of $R^2$. Of the groups described above, the substituted or unsubstituted primary and secondary alkyl groups containing 1 to 12 carbon atoms are preferred in particular as $R^9$.

Among the foregoing active methylene-containing groups represented by X, $R^2COCH_2COO$—, $NCCH_2COO$—, $R^2COCH_2CO$— and NC—$CH_2CO$— [wherein $R^2$ has the same meaning as the above] can produce especially desirable effects in the invention.

Examples of an active methylene group-containing ethylenically unsaturated monomer represented by formula (I) are described below, but these examples should not be construed as limiting the scope of the invention.

M-1: 2-Acetoacetoxyethyl methacrylate
M-2: 2-Acetoacetoxyethyl acrylate
M-3: 2-Acetoacetoxypropyl methacrylate
M-4: 2-Acetoacetoxypropyl acrylate
M-5: 2-Acetoacetoxyamidoethyl methacrylate
M-6: 2-Acetoacetoxyamidoethyl acrylate
M-7: 2-Cyanoacetoxyethyl methacrylate
M-8: 2-Cyanoacetoxyethyl acrylate
M-9: N-(2-cyanoacetoxyethyl)acrylamide
M-10: 2-Propionylacetoxyethyl acrylate
M-11: N-(2-propionylacetoxyethyl)methacrylamide
M-12: N-4-(acetoacetoxybenzyl)phenylacrylamide
M-13: Ethylacryloyl acetate
M-14: Acryloylmethyl acetate
M-15: N-methacryloyloxymethylacetoacetamide
M-16: Ethylmethacryloylacetoacetate
M-17: N-allylcyanoacetamide
M-18: Methylacryloylacetoacetate
M-19: N-(2-methacryloyloxymethyl)cyanoacetamide
M-20: p-(2-Acetoacetyl)ethylstyrene
M-21: 4-Acetoacetyl-1-methacryloylpiperazine
M-22: Ethyl-α-acetoacetoxymethacrylate
M-23: N-butyl-N-acryloyloxyethylacetoacetamide
M-24: p-(2-Acetoacetoxy)ethylstyrene Of the monomers described above, M-1, M-2, M-5, M-6, M-7, M-8, M-17 and M-19 are preferred over the others.

Examples of a monomer containing at least two ethylenically unsaturated groups include polyfunctional acrylic acid esters, polyfunctional methacrylic acid esters, polyfunctional acrylamides, polyfunctional methacrylamides and polyfunctional benzenes. More specifically, these polyfunctional monomers are, e.g., divinylbenzene, ethylene glycol dimethacrylate, diethylene glycol dimethacrylate, triethylene glycol dimethacrylate, ethylene glycol diacrylate, diethylene glycol diacrylate, 1,6-hexamediol diacrylate, neopentyl glycol dimethacrylate and tetramethylene dimethacrylate. Of the monomers described above, divinylbenzene and ethylene glycol dimethacrylate are preferred in particular.

Other copolymerizable ethylenically unsaturated monomers may be employed as constitutional monomers of the present polymer latex. Examples of such a copolymerizable ethylenically unsaturated monomer include acrylic acid, acrylic acid esters, methacrylic acid, methacrylic acid esters, crotonic acid, crotonic acid esters, vinyl esters, maleic acid, maleic acid diesters, fumaric acid, fumaric acid diesters, itaconic acid, itaconic acid diesters, acrylamides, methacrylamides, vinyl ethers and styrenes. The acids described above may be in the form of alkali metal (e.g., Na, K) salt or ammonium salt.

More specifically, the following are concrete examples of those monomers.

Examples of an acrylic acid ester usable in the copolymerization include methyl acrylate, ethyl acrylate, n-propyl acrylate, isopropyl acrylate, n-butyl acrylate, sodium 3-acryloylpropanesulfonate, acetoxyethyl acrylate, phenyl acrylate, 2-methoxyethyl acrylate, 2-ethoxyethyl acrylate and 2-(2-methoxyethoxy)ethyl acrylate. Examples of a methacrylic acid ester usable in the copolymerization include methyl methacrylate, ethyl methacrylate, n-propyl methacrylate, n-butyl methacrylate, tert-butyl methacrylate, cyclohexyl methacrylate, 2-hydroxyethyl methacrylate and 2-ethoxyethyl methacrylate.

Examples of a crotonic acid ester usable in the copolymerization include butyl crotonate and hexyl crotonate, those of a vinyl ester include vinyl acetate, vinyl propionate, vinyl butyrate and vinyl benzoate, those of a maleic acid diester include diethyl maleate, dimethyl maleate and dibutyl maleate, those of a fumaric acid diester include diethyl fumarate, dimethyl fumarate and dibutyl fumarate, and those of an itaconic acid diester include diethyl itaconate, dimethyl itaconate and dibutyl itaconate.

Examples of an acrylic compound usable in the copolymerization include acrylamide, methacrylamide, ethyl acrylamide, isopropyl acrylamide, n-butyl acrylamide, diacetone acrylamide, acryloyl morpholine, and sodium acrylamide-2-methylpropanesulfonate. Examples of a methacrylamide usable in the copolymerization include methacrylamide, methyl methacrylamide, ethyl methacrylamide, n-butyl methacrylamide, tert-butyl methacrylamide, 2-methoxymethacrylamide, dimethyl methacrylamide and diethyl methacrylamide.

Examples of a vinyl ether usable in the copolymerization include methyl vinyl ether, butyl vinyl ether, hexyl vinyl ether, methoxyethyl vinyl ether and dimetylaminoethyl vinyl ether. Examples of a styrene usable in the copolymerization include styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, vinylbenzoic acid methyl ester-2-methylstyrene, sodium styrenesulfonate and vinylbenzoic acid.

Of those monomers, acrylic acid esters, methacrylic acid esters, acrylamides, methacrylamides and styrenes are preferred over the others. These monomers may be used as a mixture of two or more thereof.

In the copolymerization for preparing the present polymer latex, it is desirable to use an active methylene group-containing ethylenically unsaturated monomer in a proportion of 0.1 to 99.9 weight %, preferably 0.5 to 50.0 weight %, particularly preferably 1.0 to 30.0 weight %, an at least two ethylenically unsaturated groups-containing monomer in a proportion of 0.01 to 50.0 weight %, preferably 0.1 to 30.0 weight %, particularly preferably 1.0 to 20.0 weight %, and other copolymerizable ethylenically unsaturated monomers in a proportion of 0 to 99.89 weight %, preferably 20.0 to 99.4 weight %, particularly preferably 50.0 to 98.0 weight %.

The present polymer latex is prepared by a well-known emulsion polymerization method, and the suitable sizes of polymer particles therein are in the range of 0.001 to 1.0 μm, preferably 0.01 to 0.5 μm. It is desirable that the emulsion polymerization method be carried out by emulsifying monomers in water or a mixture of water and a water-miscible organic solvent (e.g., methanol, ethanol, acetone) in the presence of at least one kind of emulsifier and then polymerizing the monomers by the use of a radical polymerization initiator at the temperature chosen generally from the range of 30° C. to about 100° C., preferably from the range of 40° C. to about 90° C. The suitable proportion of a water-miscible organic solvent to water is from 0 to 100 % by volume, preferably from 0 to 50 % by volume. In general, the polymerization reaction is carried out using a radical polymerization initiator in a proportion of 0.05 to 5 weight % to the monomers to be polymerized and, if needed, an emulsifier in a proportion of 0.1 to 10 weight % to the monomers to be polymerized. Examples of a polymerization initiator usable therein include azobis compounds, peroxides, hydroperoxides and redox solvents. More specifically, potassium persulfate, ammonium persulfate, tert-butyl peroctoate, benzoyl peroxide, isopropyl percarbonate, 2,4-dichlorobenzyl peroxide, methyl ethyl ketone peroxide, cumene hydroperoxide, dicumyl peroxide, 2,2'-azobisisobutyrate and 2,2'-azobis(2-amidinopropane) hydrochloride are suitably employed.

The emulsifiers usable therein are water-soluble polymers as well as anionic, cationic, amphoteric and nonionic surfactants. Examples thereof include sodium laurinate, sodium dodecylsulfate, sodium 1-octoxycarbonylmethyl-1-octoxycarbonylmethanesulfonate, sodium laurylnaphthalene-sulfonate, sodium laurylbenzenesulfonate, sodium laurylphosphate, cetyltrimethylammonium chloride, dodecyltrimethylammonium chloride, N-2-ethylhexylpyridinium chloride, polyoxyethylene nonyl phenyl ether, polyoxyethylene sorbitan lauryl ester, polyvinyl alcohol, the emulsifiers disclosed in JP-B-53-6190 (the term "JP-B" as used herein means an "examined Japanese patent publication"), and water-soluble polymers. In the aforementioned emulsion polymerization, needless to say, the polymerization initiator, the concentration thereof, the polymerization temperature and the reaction time can be widely and easily changed depending on the intended purpose. Additionally, either the way in which the monomers, the surfactant(s) and the medium are all placed in advance in a vessel and therein the initiator is thrown to set off the reaction, or the way in which the monomers are polymerized while dripping only part or all of each component into a vessel may be employed for effecting the emulsion polymerization reaction.

Examples of a latex of polymer containing active methylene groups in accordance with the invention are described below, but these examples should not be construed as limiting the scope of the invention in any way. The notes in parentheses appended to each example are the ratio (in terms of percentage by weight) between the constituent monomers of each copolymer, the particle size of each polymer latex and the glass transition temperature (Tg) of each copolymer respectively.

P-1 M-1/ethylene glycol dimethacrylate/methyl acrylate copolymer (16/10/74, 0.12 μm, 42° C.)

P-2 M-1/ethylene glycol dimethacrylate/ethyl acrylate/acrylic acid copolymer (4/10/62/24, 0.12 μm, 16° C.)

P-3 to P-12 M-1/ethylene glycol dimethacrylate/n-butyl acrylate/acrylic acid copolymer (x/y/z/w)

P-3 x/y/z/w (1/5/90/4, 0.13 μm, −44° C.)

P-4 x/y/z/w (2/5/89/4, 0.14 μm, −43° C.)

P-5 x/y/z/w (4/5/87/4, 0.13 μm, −40° C.)

P-6 x/y/z/w (8/5/83/4, 0.14 μm, −34° C.)

P-7 x/y/z/w (12/5/79/4, 0.14 μm, −29° C.)

P-8 x/y/z/w (16/5/75/4, 0.13 μm, −23° C.)

P-9 x/y/z/w (8/1/87/4, 0.13 μm, −39° C.)

P-10 x/y/z/w (8/3/85/4, 0.13 μm, −37° C.)

P-11 x/y/z/w (8/10/78/4, 0.15 μm, −29° C.)

P-12 x/y/z/w (8/20/68/4, 0.16 μm, −16° C.)

P-13 M-2/diethylene glycol dimethacrylate/2-ethylhexyl acrylate copolymer (8/5/87, 0.09 μm, −35° C.)

P-14 M-2/divinylbenzene/styrene/methacrylic acid copolymer (8/5/77/10, 0.08 μm, 108° C.)

P-15 M-5/ethylene glycol dimethacrylate/isopropyl acrylamide copolymer (16/10/74, 0.11 μm, 110° C.)

P-16 M-5/ethylene glycol dimethacrylate/methyl methacrylamide/2-acrylamido-2-methyl-1-propanesulfonic acid copolymer (16/10/64/10, 0.11 μm, 105° C.)

P-17 M-6/ethylene glycol diacrylate/ethyl acrylate/acrylic acid copolymer (20/20/55/5, 0.13 μm, 33° C.)

P-18 M-6/diethylene glycol diacrylate/methyl methacrylate/acrylic acid copolymer (20/20/55/5, 0.14 μm, 112° C.)

P-19 M-7/ethylene glycol dimethacrylate/n-butyl acrylate/acrylic acid copolymer (8/10/78/4, 0.16 μm, −40° C.)

P-20 M-7/divinylbenzene/methyl methacrylate/acrylic acid copolymer (8/5/77/10, 0.10 μm, 118° C.)

P-21 M-8/ethylene glycol diacrylate/methyl methacrylate/2-acrylamido-2-methyl-1-propanesulfonic acid copolymer (8/10/78/4, 0.12 μm, 113° C.)

P-22 M-8/divinylbenzene/styrene/melthacrylic acid copolymer (8/5/77/10, 0.09 μm, 118° C.)

P-23 M-17/ethylene glycol dimethacrylate/diacetone acrylamide/methacrylic acid copolymer (8/10/72/10, 0.07 μm, 100° C.)

P-24 M-17/divinylbenzene/styrene/2-acrylamido-2-methyl-1-propanesulfonic acid copolymer (8/5/83/4, 0.07 μm, 105° C.)

P-25 M-19/diethylene glycol dimethacrylate/isopropyl acrylamide copolymer (16/25/59, 0.14 μm, 103° C.)

P-26 M-19/divinylbenzene/styrene/2-acrylamido-2-methyl-1-propanesulfonic acid copolymer (8/5/83/4, 0.07 μm, 117° C.)

The active methylene group-containing ethylenically unsaturated monomers, which can constitute the polymer latexes used in the invention, and various polymer latexes comprising such monomers are described in, e.g., U.S. Pat. Nos. 3,459,790, 3,619,195, 3,929,482 and 3,700,456, West German Patent 2,442,165, European Patent 13,147, JP-A-50-73625 and JP-A-50-146331, and can be synthesized by reference to the descriptions therein.

The suitable proportion of the latexes of copolymers having the glass transition temperatures (Tg) as described above to the binder which can make the thermal expansion coefficient at least 0.9 and less than 1.0 is from 5 to 60 weight%, preferably from 10 to 50 weight %, on a solids basis. Additionally, mixing the latexes of copolymers having such Tg with the binder causes a rise in the thermal expansion coefficient, and brings the thermal expansion coefficient close to 1.0. The suitable thermal expansion coefficient of the layer formed with such a mixed binder is from 0.95 to less than 1.0, preferably 0.98 to less than 1.0 (more specifically at most 0.999).

Additionally, the Tg is required to be not higher than a heat development temperature, preferably not higher than 130° C. The Tg has no particular lower limit, but the lower limit thereof is usually around −50° C. The suitable polymer latex may be chosen from consideration of heat development temperature. When the heat development is carried out at various temperatures, the lowest development temperature is taken as a criterion for selecting the polymer latex.

It is desirable for the layer having the thermal expansion coefficient of at least 0.9 and less than 1.0, in which the polymer latex chosen from consideration of Tg is incorporated, to be a surface protective layer. When the protective layer has a multilayer structure constituted of at least two layers, the layer having the thermal expansion coefficient specified above may be at least one of such constituent layers.

The amount of total binders comprised in the surface protective layer having two or more constituent layers is from 0.5 to 10 g/m$^2$, preferably from 1 to 5 g/m$^2$, all told.

The top most surface protective layer in the invention may contain a matting agent. In general the matting agent preferably used therein is made up of fine particles of a water-insoluble organic or inorganic compound. Specifically, the matting agent used in the foregoing layer may be any of matting agents well-known in this industry, including the organic matting agents disclosed, e.g., in U.S. Pat. Nos. 1,939,213, 2,701,245, 2,322,037, 3,262,782, 3,539,344 and 3,767,448 and the inorganic matting agents disclosed, e.g., in U.S. Pat. Nos. 1,260,772, 2,192,241, 3,257,206, 3,370,951, 3,523,022 and 3,769,020. Suitable examples of an organic compound which can be practically used for the matting agent include vinyl polymers dispersible in water, such as polymethylacrylate, polymethylmethacrylate, polyacrylonitrile, acrylonitrile-α-methylstyrene copolymer, polystyrene, styrene-divinylbenzene copolymer, polyvinyl acetate, polyethylene carbonate and polytetrafluoroethylene; cellulose derivatives, such as methyl cellulose, cellulose acetate and cellulose acetate propionate; starch derivatives, such as carboxyl starch, carboxynitrophenyl starch and urea-formaldehyde-starch reaction products; and hardened gelatins, such as gelatins hardened with known hardeners and gelatins hardened by coacervation to be made into microencapsulated hollow particles. Suitable examples of an inorganic compound which can be used for the same purpose as the above include silicon dioxide, titanium dioxide, magnesium dioxide, aluminum oxide, barium sulfate, calcium carbonate, silver chloride and silver bromide desensitized by a known method, glass and diatomaceous earth. In using the matting agent as described above, different substances can be mixed therewith, if desired.

In carrying out the invention, it is further desirable to use a matting agent having average particle size of 2 to 6 μm. And the particle size distribution of the matting agent may be narrow or broad. On the other hand, the matting agent exerts a great influence upon the haze and surface gloss of a photosensitive material. Therefore, it is desirable to control the particle size, shape and particle size distribution of the matting agent depending on the situation at the time of the preparation or by mixing with other matting agents.

Additionally, the particle size of the matting agent used in the invention is defined as the average diameter calculated from equivalent-circle diameters corresponding to projected areas determined using an electron microscope.

The suitable coverage of the matting agent is in the range of 1 to 400 mg/m$^2$, preferably 5 to 300 mg/m$^2$. In particular, it is desirable that the coverage of particles having a size of at least 4 μm be from 5 to 150 mg/m$^2$.

The protective layer is most suitable for the addition of a matting agent on the side of image forming layers or photosensitive layers. The protective layer can be constituted of two or more layers, if desired. In this case, it is possible to choose which layer(s) should be added to each of additives participating in development, a film surface pH modifier, a charge modifier, an ultraviolet absorbent, a slipping agent and a surfactant. Therefore, the protective layer can be designed so as to improve not only coatability and production suitability but also image quality. In the outermost protective layer, it is desirable to contain a fluorine-containing surfactant together with the matting agent. Examples of such a fluorine-containing surfactant include the fluorine-containing polymeric surfactants as disclosed in JP-A-62-170950 and U.S. Pat. No. 5,380,644 and the fluorine-containing surfactants as disclosed in JP-A-60-244945 and JP-A-63-188135.

In the invention, it is desirable that the matting agent be contained in the outermost protective layer.

Further, the matting agent can also be added to a backing layer. In this case, it is desirable that the matting agent-added layer be not the outermost layer on the rear side.

It is all right to use a hardener in each of the constituent layers of the present photothermographic or thermographic material, including an image forming layer (preferably a photosensitive layer), a protective layer and a backing layer. Examples of a usable hardener are described in T. H. James, *THE THEORY OF THE PHOTOGRAPHIC PROCESS,* 4th ed., pp. 77–87, Macmillan Publishing Co., Inc. (1977). More specifically, the polyvalent metal ions as described in T. H. James, supra, p. 78, the polyisocyanates as disclosed in U.S. Pat. No. 4,281,060 and JP-A-6-208193, the epoxy compounds as disclosed in U.S. Pat. No. 4,791,042 and the vinylsulfone compounds as disclosed in JP-A-62-89048 are used to advantage.

Any adhesion inhibiting materials may be used for the surface protective layer according to the invention. Examples of a usable adhesion inhibiting material include wax, silica grains, styrene-containing elastomeric block copolymers (e.g., styrene-butadiene-styrene block copolymer, styrene-isoprene-styrene block copolymer), cellulose acetate, cellulose acetate butyrate, cellulose propionate and mixtures of two or more thereof. To the surface protective layer may further be added a cross-linking agent for cross-linkage and a surfactant for improvement of coating properties.

In the present image forming layer or the present protective layer therefor can be used the light-absorbing substances and the filter dyes as disclosed in U.S. Pat. Nos. 3,253,921, 2,274,782, 2,527,583 and 2,956,879. Further, the dyes used therein can be mordanted as described in U.S. Pat. No. 3,282,699.

In the image forming layer or the protective layer therefor can be contained a matting agent, such as starch, titanium dioxide, zinc oxide, silica and polymer beads, including the beads of such kinds as disclosed in U.S. Pat. Nos. 2,992,101 and 2,701,245. The present photothermographic or thermographic material has any degree of matt on the emulsion side so far as it causes no stardust trouble. However, it is desirable that the Bekk smoothness on the emulsion side be from 200 to 10,000 seconds, particularly from 300 to 10,000 seconds.

The photothermographic materials are illustrated below in greater detail.

It is desirable for the photothermographic material to be a mono-sheet type (or the type which does not use another sheet, e.g., an image-receiving sheet, but forms images on the photothermographic material itself). The present invention is particularly effective for photothermographic materials to be exposed to red to infrared light.

The photothermographic material has a photosensitive layer comprising photosensitive silver halide (a photocatalyst in a catalytically activating amount) and optionally a reducing agent, and a photoinsensitive layer. It is desirable that the photosensitive layer further comprise a binder (generally a synthetic polymer) and an organic silver salt (reducible silver source). In addition to those constituents, it is also desirable for the photosensitive layer to comprise a hydrazine compound (ultra high-contrast imparting agent) and a color tone adjusting agent (for controlling the color tone of silver). The photothermographic material may have two or more photosensitive layers. For instance, high-speed and low-speed photosensitive layers may be formed in the photothermographic material with the intention of controlling the gradation. As to the arranging order of these high-speed and low-speed photosensitive layers, the low-speed photosensitive layer may be arranged nearer to the support than the high-speed photosensitive layer, or vice versa.

The photoinsensitive layer may be provided as another functional layer, such as a surface protective layer, in addition to dye-containing layers, namely a filter layer and antihalation layer.

Examples of a support usable for the photothermographic material include paper, polyethylene-coated paper, polypropylene-coated paper, parchment paper, cloth, sheets or thin films of metals (e.g., aluminum, copper, magnesium, zinc), glass, glass coated with metals (e.g., chromium alloy, steel, silver, gold, platinum) and plastic films. Of these support materials, transparent plastic films are preferred over the others. Examples of plastics used for the support include polyalkylmethacrylates (e.g., polymethylmethacrylate), polyesters (e.g., polyethylene terephthalate: PET), polyvinyl acetal, polyamides (e.g., nylon) and cellulose esters (e.g., cellulose nitrate, cellulose acetate, cellulose acetate propionate, cellulose acetate butyrate). The suitable thickness of the support is from 90 to 190 $\mu$m, especially from 150 to 185 $\mu$m.

The support may be covered with a polymer. Examples of a polymer usable for covering include polyvinylidene chloride, polymers of acrylic acid derivatives (e.g., polyacrylonitrile, polymethyl acrylate), polymers of unsaturated dicarboxylic acids (e.g., itaconic acid), carboxymethyl cellulose and polyacrylamide. Also, copolymers may be used for covering. Instead of covering the support with a polymer, the subbing layer containing a polymer may be provided on the support.

The silver halide used as photocatalyst may be any of silver bromide, silver iodide, silver chloride, silver iodobromide and silver chloroiodobromide. The distribution of halide composition in silver halide grains may be uniform, or it may be changed stepwise or continuously. Also, it is desirable to use silver halide grains having a core/shell structure. Suitable examples of such a core/shell structure include double to quintuple structures, preferably double to quadruple structures. Further, the technique of localizing silver bromide on the silver chloride or chlorobromide grain surface can be used to advantage.

The grain size of silver halide is from 0.001 to 0.04 $\mu$m, preferably from 0.005 to 0.04 $\mu$m. The term "grain size" used herein means an average value calculated from equivalent-circle diameters corresponding to projected areas of grains determined using an electron micrograph.

The suitable addition amount of silver halide expressed in coverage per $m^2$ of a photosensitive material is from 0.03 to 0.6 $g/m^2$, preferably from 0.05 to 0.4 $g/m^2$, particularly preferably from 0.1 to 0.4 $g/m^2$.

The methods for forming photosensitive silver halide are well known in the art. For instance, the methods described in Research Disclosure, No. 17029 (June, 1978) and U.S. Pat. No. 3,700,458 can be employed. Specifically, the silver halide is prepared as a silver halide emulsion by the reaction between silver nitrate and water-soluble halide. Additionally, it may be prepared by reacting silver soap with halogen ion to replace the soap moiety of silver soap by halogen ion. In another way, the halogen ion may be added at the formation of silver soap.

In addition to the references described above, the details of photosensitive silver halide are referred to in JP-A-10-339934, paragraph Nos. 0102 to 0109.

In general the silver halide is spectrally sensitized before use. The spectral sensitizing dyes usable therein include those disclosed in JP-A-60-140335, JP-A-63-159841, JP-A-63-231437, JP-A-63-259651, JP-A-63-304242, JP-A-63-15245, U.S. Pat. Nos. 4,639,414, 4,740,455, 4,741,966, 4,751,175 and 4,835,096, and JP-A-10-339934, paragraph Nos. 0136 to 0145.

Suitable reducing agents for the present photothermographic material include, e.g., phenidone, hydroquinones, catechol and hindered phenols. The details of these reducing agents can be referred to in U.S. Pat. Nos. 3,770,448, 3,773,512, 3,593,863 and 4,460,681, and Research Disclosure, Nos. 17029 and 29963.

Examples of a reducing agent usable in the invention include aminohydroxycycloalkenone compounds (e.g., 2-hydroxypiperidino-2-cyclohexenone), N-hydroxyurea derivatives (e.g., N-p-methylphenyl-N-hydroxyurea), aldehydes or ketones of hydrazones (e.g., anthracenealdehydophenylhydrazone), phosphamidophenols, phosphoramidoanilines, polyhydroxybenzenes (e.g., hydroquinone, t-butylhydroquinone, isopropylhydroquinone, 2,5-dihydroxyphenylmethylsulfone), sulfohydroxamic acids (e.g., benzenesulfohydroxamic acid), sulfonamidoanilines (e.g., 4-(N-methanesulfonamido)aniline), 2-tetrazolylthiohydroquinones (e.g., 2-methyl-5-(1-phenyl-5-tetrazolylthio)hydroquinone), tetrahydroquinoxalines (e.g., 1,2,3,4-tetrahydroquinoxaline), amidoxines, combinations of azines (e.g., aliphatic carboxylic acid arylhydrazide) with ascorbic acid, combinations of polyhydroxybenzenes with hydroxylamine, reductone, hydrazine, hydroxamic acids, combinations of azines with sulfonamidophenols, α-cyanophenylacetic acid derivatives, combinations of bis-β-naphthol with 1,3-dihydroxybenzene derivatives, 5-pyrazolones, sulfonamidophenols, 2-phenylindane-1,3-dione, chroman, 1,4-dihydropyridines (e.g., 2,6-dimethoxy-3,5-dicarboethoxy-1,4-dihydropyridine), bisphenols (e.g., bis(2-hydroxy-3-t-butyl-5-methylphenyl)methane, bis(6-hydroxy-m-tolyl)mesitol, 2,2-bis(4-hydroxy-3-methylphenyl)propane, 1,1-bis(2-hydroxy-3,5-dimethylphenyl)-3,5,5-trimethylhexane, 4,4-ethylidene-bis(2-t-butyl-6-methylphenol), ultraviolet-responsive ascorbic acid derivatives and 3-pyrazolidones.

Additionally, the compounds capable of functioning as precursors of a reducing agent, e.g., esters of aminoreductones (such as piperidinohexose reductone monoacetate) may be used in place of the reducing agent.

In particular, hindered phenols are preferred as reducing agents used in the invention.

The suitable amount of a reducing agent added is from 0.01 to 5.0 g/m$^2$, preferably from 0.1 to 3.0 g/m$^2$.

It is desirable that both photosensitive and photoinsensitive layers contain a binder. In general the binder used is a colorless, transparent or translucent polymer.

The effects of the invention become higher when the photosensitive layer is formed by coating and drying a coating solution wherein at least 30 % of the solvent is water, and besides, the main binder (the binder comprising at least 50 weight %, preferably at least 70 weight %, particularly preferably at least 80 weight %, of the total binders in the photosensitive layer) is a polymer soluble or dispersible in an aqueous solvent (water solvent), especially a polymer latex having an equilibrium moisture content of at most 2 weight % under the condition of 25° C. and 60% RH.

The term "aqueous solvent" as used herein, in which the main binder of the present photosensitive layer (also referred to as the present polymer) is soluble or dispersible, is intended to include water and a solvent prepared by mixing water with at most 70 weight % of a water-miscible organic solvent. Examples of a water-miscible organic solvent usable therein include alcohol solvents such as methyl alcohol, ethyl alcohol and propyl alcohol, cellosolve solvents such as methyl cellosolve, ethyl cellosolve and butyl cellosolve, ethyl acetate and dimethylformamide.

Additionally, the term "aqueous solvent" is also used herein for a solvent in which the polymer is not in thermodynamically dissolved state but in the so-called dispersed state.

The term "equilibrium moisture content under the condition of 25° C. and 60% RH" as used herein can be defined by the following equation using the weight of a polymer in humidity equilibrium under the atmosphere of 25° C. and 60% RH (W1) and the bone dry weight of the polymer at 25° C. (W0):

$$\text{Equilibrium moisture content under condition of 25° C. and 60% RH} = [(W1-W0)/W0] \times 100 \text{ (weight \%)}$$

For details of the definition and measurement method of the moisture content, various books, e.g., *Kobunshi Kogaku Koza* (which means "Lectures on Macromolecular Engineering"), Vol. 14 entitled Kobunshi Zairyo Shikenho (which means "Methods of testing macromolecular materials"), compiled by Kobunshi Gakkai, published by Chijinshokan, can be referred to.

The suitable equilibrium moisture content in the present polymer under the condition of 25° C. and 60% RH is not higher than 2 weight %, preferably from 0.01 to 1.5 weight %, particularly preferably from 0.02 to 1 weight %.

The polymer for use in the present invention is not particularly limited so long as the polymer is soluble or dispersible in the above-described aqueous solvent and has an equilibrium moisture content of at most 2 weight % under the condition of 25° C. and 60% RH. Among these polymers, polymers dispersible in the aqueous solvent are particularly preferred.

The polymer in a dispersed state may preferably be any of a latex as fine solid polymer particles dispersed in water, the polymer dispersed in molecular state and the polymer dispersed in a micellar state.

In preferred embodiments of the invention, it is desirable to use hydrophobic polymers, such as acrylic resins, polyester resins, rubbery resins (e.g., SBR resin), polyurethane resins, vinyl chloride resins, vinyl acetate resins, vinylidene chloride resins and polyolefine resins. Such hydrophobic polymers may be straight-chain, branched or cross-linked polymers. Further, they may be the so-called homopolymers produced by polymerizing only one kind of monomer, or copolymers produced by polymerizing two or more kinds of monomers. As for the copolymers, both random copolymer and block copolymer are usable. The suitable molecular weight of such polymers is from 5,000 to 1,000,000, preferably from 10,000 to 200,000, expressed in terms of number average molecular weight. When the polymer used has too low molecular weight, it cannot impart sufficient mechanical strength to the resultant emulsion layer; while, when it has too high molecular weight, the film formability thereof becomes poor.

As examples of a polymer latex which can be used to advantage in the invention, mention may be made of the following latexes. Each numerical value in parentheses is a fraction of the corresponding constituent monomer, expressed in weight %, and the molecular weight in parentheses is expressed in terms of number average molecular weight.

L-1: Latex of -MMA(70)-EA(27)-MAA(3)- (molecular weight: 37,000)

L-2: Latex of -MMA(70)-2EHA(20)-St(5)-AA(5)- (molecular weight: 40,000)

L-3: Latex of -St(50)-Bu(47)-MAA(3)- (molecular weight: 45,000)

L-4: Latex of -St(68)-Bu(29)-AA(3)- (molecular weight: 60,000)

L-5: Latex of -St(70)-Bu(27)-IA(3)- (molecular weight: 120,000)

L-6: Latex of -St(75)-Bu(24)-AA(1)- (molecular weight: 108,000)

L-7: Latex of -St(60)-Bu(35)-DVB(3)-MAA(2)- (molecular weight: 150,000)

L-8: Latex of -St(70)-Bu(25)-DVB(2)-AA(3)- (molecular weight: 280,000)

L-9: Latex of -VC(50)-MMA(20)-EA(20)-AN(5)-AA(5)- (molecular weight: 80,000)

L-10: Latex of -VDC(85)-MMA(5)-EA(5)-MAA(5) (molecular weight: 67,000)

L-11: Latex of -Et(90)-MAA(10)- (molecular weight: 12,000)

L-12: Latex of -St(70)-2EHA(27)-AA(3)- (molecular weight: 130,000)

L-13: Latex of -MMA(63)-EA(35)-AA(2)- (molecular weight: 33,000)

The abbreviations used for representing monomers constituting the polymers described above are as follows:

MMA, methyl methacrylate; EA, ethyl acrylate; MAA, methacrylic acid; 2EHA, 2-ethylhexyl acrylate; St, styrene; Bu, butadiene; AA, acrylic acid; DVB, divinylbenzene; VC, vinyl chloride; AN, acrylonitrile; VDC, vinylidene chloride; Et, ethylene; IA, itaconic acid.

The polymer latexes described above are on the market today, and the following polymers can be used therein. Examples of commercial acrylic resin include Sebian A-4635, 46583 and 4601 (produced by Daicell Chemical Industry K.K.) and Nipol Lx811, 814, 821, 820 and 857 (produced by Nippon Zeon K.K.). Examples of commercial polyester resin include FINETEX ES650, 611, 675 and 850 (produced by Dai-Nippon Ink & Chemicals, Inc.), and WD-size and WMS (produced by Eastman Chemical Products, Inc.). Examples of commercial polyurethane resin include HYDRAN AP10, 20, 30 and 40 (produced by Dai-Nippon Ink & Chemicals, Inc.). Examples of commercial rubber resin include LACSTAR 7310K, 3307B, 4700H and 7132C (produced by Dai-Nippon Ink & Chemicals, Inc.), and Nipol Lx416, 410, 438C and 2507 (produced by Nippon Zeon K. K.). Examples of commercial vinyl chloride resin include G351 and G576 (produced by Nippon Zeon K.K.), those of commercial vinylidene chloride resin include L502 and L513 (produced by Asahi Chemical Industry Co., Ltd.), and those of commercial olefin resin include Chemipearl S120 and SA100 (produced by Mitsui Petrochemical Industries, Ltd.).

Those polymer latexes may be used alone, or may be blended with two or more thereof, if desired.

As the polymer latex used in the invention, the latex of a styrene-butadiene copolymer is preferred in particular. The suitable ratio between the constitutional units derived from styrene monomer and those from butadiene monomer in the styrene-butadiene copolymer is from 40:60 to 95:5 by weight. And the suitable total proportion of monomeric units from styrene and those from butadiene in the copolymer is from 60 to 99 weight %. The suitable molecular weight range for such a copolymer is the same as mentioned above.

The latexes of styrene-butadiene copolymers which are used to advantage in the invention include L-3 to L-8 described above and the commercially available products, such as LACSTAR-3307B, 7132C, and Nipol Lx416.

To a photosensitive layer of the present photosensitive material, hydrophilic polymers, such as gelatin, polyvinyl alcohol, methyl cellulose and hydroxypropyl cellulose, may be added, if desired. In this case, it is desirable that these hydrophilic polymers be added in a proportion of at most 30 weight %, preferably at most 20 weight %, to the total binders in the photosensitive layer.

In other words, the-polymer latexes as described above are preferably used for forming the present photosensitive layer. Further, it is desirable that the ratio of total binders to organic silver salt in the photosensitive layer be from 1/10 to 10/1, preferably 1/5 to 4/1, by weight.

In addition, the suitable ratio of total binders to silver halide in the photosensitive layer is from 400 to 5, preferably from 200 to 10, by weight.

In the present photosensitive layer, it is desirable for the total binders to have a coverage of from 0.2 to 30 g/m$^2$, preferably from 1 to 15 g/m$^2$. At the time the present photosensitive layer is formed, a cross-linking agent for cross-linkage and a surfactant for improvement of coating properties may be added thereto.

The solvent (which is intended herein to include both solvent and dispersion medium for simplification of the description) of a coating solution for forming a photosensitive layer of the present photosensitive material is an aqueous solvent containing water in a proportion of at least 30 weight %. The solvents, other than water, usable therein include water miscible organic solvents, such as methyl alcohol, ethyl alcohol, isopropyl alcohol, methyl cellosolve, ethyl cellosolve, dimethylformamide and ethyl acetate. The suitable proportion of water in the solvent of coating solution is at least 50 weight %, preferably at least 70 weight %. As suitable examples of a solvent composition, mention may be made of water alone, 90:10 mixture of water and methyl alcohol, 70:30 mixture of water and methyl alcohol, 80:15:5 mixture of water, methyl alcohol and dimethylformamide, 85:10:5 mixture of water, methyl alcohol and ethyl cellosolve, and 85:10:5 mixture of water, methyl alcohol and isopropyl alcohol. (Each numerical value is expressed in weight %.)

Furthermore, it is desirable for the photosensitive layer to comprise a photoinsensitive organic silver salt. Such a photoinsensitive organic silver salt may also be contained in a photoinsensitive layer. The organic acids suitable for the silver salt formation are long-chain fatty acids. The appropriate number of carbon atoms present in such a fatty acid is from 10 to 30, preferably from 15 to 25. Also, the organic silver salts may be complexes. It is desirable for the ligands of such a complex to having their total stability constant to silver ion in the range of 4.0 to 10.0. The detailed description of organic silver salts can be found in *Research Disclosure,* Nos. 17029 and 29963, and JP-A-10-339934, paragraph Nos. 0092 to 0101.

Examples of an organic silver salt usable in the foregoing layers include silver salts of fatty acids (e.g., gallic acid, oxalic acid, behenic acid, stearic acid, palmitic acid, lauric acid), silver salts of carboxyalkylthioureas (e.g., 1-(3-carboxypropyl)thiourea, 1-(3-carboxypropyl)-3,3-dimethylthiourea), silver complexes of the products of polymerization reaction between aldehydes (e. g., formaldehyde, acetaldehyde, butyraldehyde) and hydroxy-substituted aromatic carboxylic acids, silver salts of aromatic carboxylic acids (e.g., salicylic acid, benzoic acid, 3,5-dihydroxybenzoic acid, 5,5-thiodisalicylic acid), silver salts or complexes of thioenes (e.g., 3-(2-carboxyethyl)-4-hydroxymethyl-4-thiazoline-2-thioene, 3-carboxymethyl-4-thiazoline-2-thioene), silver salts or complexes of nitrogen-containing acids (e.g., imidazole, pyrazole, urazole, 1,2,4-thiazole, 1H-tetrazole, 3-amino-5-benzylthio-1,2,4-triazole, benzotriazole), silver salt of saccharin, silver salt of 5-chlorosalicylaldoxime and silver salts of mercaptides. Of these organic silver salts, silver behenate is preferred over the others. Such organic silver salts are preferably used at a coverage of from 0.05 to 3 g/m$^2$, preferably from 0.3 to 2 g/m2, on a silver basis.

It is desirable for the photosensitive layer to further contain an ultra-high contrast imparting agent. Such an ultra-high contrast imparting agent may further be present in a photoinsensitive layer also. When the photothermographic material is used in the field of graphic arts, it becomes important to reproduce continuous tone pictures and line drawings by halftone dots. The use of ultra-high contrast imparting agent can enhance the reproducibility of halftone images and line drawings. Examples of an ultra-high contrast imparting agent usable for such a purpose include hydrazine compounds, quaternary ammonium compounds and acrylonitrile compounds (as disclosed in U.S. Pat. No. 5,545,515). Of these compounds, hydrazine compounds are especially preferred as ultra-high contrast imparting agent.

The hydrazine compounds include hydrazine ($H_2N$—$NH_2$) and compounds obtained by substituting a certain group for at least one hydrogen atom of hydrazine. More specifically, the groups which can be substituted for hydrogen atoms of hydrazine include aliphatic groups, aromatic groups and heterocyclic groups. These groups may be attached to nitrogen atoms of hydrazine directly, or via linkage groups. Examples of such linkage groups include —CO—, —Cs—, —$SO_2$—, —POR— (wherein R represents an aliphatic, aromatic or heterocyclic group), —CNH—, and combinations of two or more thereof.

The detailed description of hydrazine compounds can be found in U.S. Pat. Nos. 5,464,738, 5,496,695, 5,512,411 and 5,536,622, JP-B-6-77138, JP-B-6-93082, JP-A-6-230497, JP-A-6-289520, JP-A-6-313951, JP-A-7-5610, JP-A-7-77783, JP-A-10-104426.

The hydrazine compounds are dissolved in an appropriate organic solvent, and then added to a coating solution for photosensitive layer. Examples of an organic solvent usable for the dissolution include alcohols (e.g., methanol, ethanol, propanol, fluorinated alcohols), ketones (e.g., acetone, methyl ethyl ketone), dimethylformamide, dimethyl sulfoxide and methyl cellosolve. In another way, the hydrazine compounds maybe dissolved in oily (auxiliary) solvent and emulsified into a coating solution. Examples of an oily solvent usable therein include dibutyl phthalate, tricresyl phosphate, glyceryl triacetate, diethyl phthalate, ethyl acetate and cyclohexanone. In still another way, the solid dispersion of hydrazine compounds may be added to a coating solution. The dispersion of hydrazine compounds can be performed with a known dispersing machine, such as a ball mill, a colloidal mill, Manton Gaulin, a microfluidizer and an ultrasonic dispersing machine.

The suitable amount of ultra-high contrast imparting agent added is from $1\times10^{-6}$ to $1\times10^{-2}$ mole, preferably from $1\times10^{-5}$ to $5\times10^{-3}$ mole, particularly preferably from $2\times10^{-5}$ to $5\times10^{-3}$ mole, per mole of silver halide.

In addition to the ultra-high contrast imparting agent as described above, a contrast enhancement accelerator may be used. Examples of such an accelerator include amine compounds (disclosed in U.S. Pat. No. 5,545,505), hydroxamic acid (disclosed in U.S. Pat. No. 5,545,507), acrylonitriles (disclosed in U.S. Pat. No. 5,545,507) and hydrazine compounds (disclosed in U.S. Pat. No. 5,558,983).

It is desirable to contain a color tone controlling agent in the photosensitive layer or the photoinsensitive layer. The description of color tone controlling agents can be found in Research Disclosure, No. 17029.

Examples of a color tone controlling agent usable in the invention include imides (such as phthalimide), cyclic imides (such as succinimide), pyrazoline-5-ones (such as 3-phenyl-2-pyrazoline-5-one and 1-phenylurazole), quinazolinones (such as quinazolinone and 2,4-thiazolidinedione), naphthalimides (such as N-hydroxy-1,8-naphthalimide), cobalt complexes (such as hexaminecobalt trifluoroacetate) mercaptanes (such as 3-mercapto-1,2,4-triazole), N-(aminomethyl)aryldicarboxyimides (such as N-(dimethylaminomethyl)phthalimide), blocked pyrazoles (such as N,N'-hexamethylene-1-carbamoyl-3,5-dimethylpyrazole), combinations of isothiuronium derivatives (such as 1,8-(3,6-dioxaoctane)bis(isothiuronium trifluoroacetate)) with photobleaching agents (such as 2-(tribromomethylsulfonyl)benzothiazole), merocyanine dyes (such as 3-ethyl-5-((3-ethyl-2-benzothiazolinylidene)-1-methylethylidene)-2-thio-2,4-oxazolidinedione), phthalazinone compounds and metal salts thereof (such as phthalazinone, 4-(1-naphthyl)phthalazinone, 6-chlorophthalazinone, 5,7-dimethyloxyphthalazinone, 2,3-dihydro-1,4-phthalazinedione and 8-methylphthalazine), combinations of phthalazinone compounds with sulfinic acid derivatives (such as sodium benzenesulfinate), combinations of phthalazinone compounds with sulfonic acid derivatives (such as sodium p-toluenesulfonate), phthalazine and derivatives thereof (such as phthalazine, 6-isopropylphthalazine and 6-methylphthalazine), combinations of phthalazines and phthalic acid, combinations of phthalazine or phthalazine adducts with dicarboxylic acids (preferably o-phenylene dicarboxylic acids) or acid anhydrides thereof (such as maleic acid anhydride, phthalic acid, 2,3-naphthalenedicarboxylic acid, phthalic acid anhydride, 4-methylphthalic acid, 4-nitrophthalic acid and tetrachlorophthalic acid anhydride), quinazolinediones, benzoxazine, naphthoxazine derivatives, benzoxazine-2,4-diones (such as 1,3-benzoxazine-2,4-dione), pyrimidines, asymmetric triazines (such as 2,4-dihydroxypyrimidine) and tetrazapentalene derivatives (such as 3,6-dimerccapto-1,4-diphenyl-1H,4H-2,3a,5,6a-tetrazapentalene). Of these compounds, phthalazines are preferred over the others.

The suitable proportion of a tone controlling agent contained on the surface of the photosensitive layer is from 0.1 to 50 mole %, preferably from 0.5 to 20 mole %, per mole of silver.

To the photosensitive layer or the photoinsensitive layer (preferably the photosensitive layer) may be added an antifoggant. As to the antifoggant, the non-mercury compounds (disclosed in U.S. Pat. Nos. 3,874,946, 4,546,075, 4,452,885, 4,756,999 and 5,028,523, British Patent Application Nos. 9221383.4, 9300147.7 and 9311790.1, JP-A-59-57234 and JP-A-10-339934, the compounds represented by formula (II)) are preferred to the mercury compounds (disclosed in U.S. Pat. No. 3,589,903).

In particular, heterocyclic compounds having halogen (F, Cl, Br, I) substituted methyl groups are advantageously used as antifoggant.

To the photothermographic material may further be added surfactants, antioxidants, stabilizers, plasticizers, ultraviolet abosrbents and/or coating aids. These various additives are each added to either photosensitive or photoinsensitive layer. For details of those additives, WO98/36322, EP-A1-803764, JP-A-10-186567 and JP-A-10-18568 can be referred to.

In the photosensitive layer according to the invention, the polyhydric alcohols (e.g., the glycerine and the diol of the kinds which are described in U.S. Pat. No. 2,960,404), the fatty acids and their esters disclosed in U.S. Pat. Nos. 2,588,765 and 3,121,060, and the silicone resin disclosed in British Patent 955,061 can be used as plasticizer and lubricant.

It is desirable that the photoinsensitive layer(s) of the present photothermographic material be made to function as filter or antihalation layer by the addition of a decolorizable dye and a base precursor. In general a photothermographic material has photoinsensitive layers in addition to photosensitive layers. The photoinsensitive layers can be classified into four groups according to location where each layer is disposed, namely (1) protective layers provided on or above the photosensitive layers (on the side far away from the support), (2) interlayers provided between photosensitive layers or between a photosensitive layer and a protective layer, (3) subbing layer(s) provided between a photosensitive layer and a support, and (4) backing layer(s) provided on the rear side of a support (on the side opposite to photosensitive layers). The filter layer is provided as a layer classified into the group (1) or (2), while the antihalation layer is provided as a layer classified into the group (3) or (4).

The addition of a decolorizable dye and a base precursor to the same photoinsensitive layer is desirable, but they may be added to two adjacent photoinsensitive layers, respectively. And it is allowable to provide a barrier layer between those photoinsensitive layers, too. The expression "the addition of a decolorizable dye and a base precursor to photoinsensitive layers" is intended to include not only the case where both of them are added to each photoinsensitive layer but also the case where they are added separately to adjacent photoinsensitive layers.

In adding a decolorizable dye to a photoinsensitive layer, the method of adding to a coating solution for the photoinsensitive layer the dye in a state of solution, emulsion or finely divided solid dispersion, or a polymer impregnated with the dye can be adopted. Also, the dye may be added to a photoinsensitive layer by the use of a polymer mordant. These addition methods are the same as the methods so far been adopted for adding dyes to conventional photothermographic materials. The description of latexes usable as polymer impregnant can be found in U.S. Pat. No. 4,199,363, West German Patent Application (OLS) Nos. 2541274and 2,541,230, EP-A-029104and JP-B-53-41091. The emulsification method for adding a dye to a polymer solution is disclosed in WO88/00723.

The amount of decolorizable dye added is chosen depending on the desired purpose. In general, the dye is used in an amount to provide an optical density (absorbance) higher than 0.1, measured at the desired wavelength. The suitable optical density is from 0.2 to 2. The amount of dye used for providing such optical densities is generally of the order of 0.001–1 $g/m^2$, preferably of the order of 0.005–0.8 $g/m^2$, particularly preferably of the order of 0.01–0.2 $g/m^2$.

Additionally, when the dye is decolorized according to the invention, the optical density can be lowered to below 0.1. Two or more of decolorizable dyes may be used together in a heat-decolorizable recording material or a photothermographic material. In analogy with the dyes, two or more of base precursors may be used in combination.

The photosensitive material according to the invention may further have an anti-static or conductive layer, such as a layer containing a soluble salt (e.g., chloride, nitrate), a metal evaporated layer, a layer containing the ionic polymer disclosed in U.S. Pat. No. 2,861,056 or 3,206,312, or a layer containing the insoluble inorganic salt disclosed in U.S. Pat. No. 3,428,451.

The methods for forming color images by the use of the present photothermographic material include those described in JP-A-7-13295, from page 10, left column, line 43, to page 11, left column, line 40. And examples of a color dye image stabilizer usable herein include those described in British Patent 1,326,889, U.S. Pat. Nos. 3,432,300, 3,698,909, 3,574,627, 3,573,050, 3,764,337 and 4,042,394.

The coating for forming the present photothermographic material may be carried out using any method. Examples of a coating operation usable therein include an extrusion coating operation, a slide coating operation, a curtain coating operation, a dip coating operation, a knife coating operation, a flow coating operation, and an extrusion coating operation by the use of a hopper of the kind disclosed in U.S. Pat. No. 2,681,294. Of these operations, the extrusion coating and slide coating operations described in Stephen F. Kistler & Petert M. Schweizer, *LIQUID FILM COATING,* pp. 399–536, Chapman & Hall (1997), are preferred over the other operations. In particular, slide coating is used to advantage. An example of the shape of a slide coater used for slide coating can be found in the book described above, page 427, FIG. 11*b*.1. In addition, simultaneous coating of two or more layers may be carried out, if desired, and therein the methods as described in the book described above, pages 399–536, U.S. Pat. No. 2,761,791 and British Patent 837,095 can be employed. The simultaneous coating is advantageous to the invention.

Surfactants may be used with the intention of enhancing coating properties and antistatic ability. They may be any of nonionic, anionic, cationic and fluorine-containing surfactants. Examples thereof include the fluoropolymer surfactants disclosed in JP-A-62-170950 and U.S. Pat. No. 5,380,644, the fluorine-containing surfactants disclosed in JP-A-60-244945 and JP-A-63-188135, the polysiloxane surfactants disclosed in U.S. Pat. No. 3,885,965, the polyalkylene oxides disclosed in JP-A-6-301140, and anionic surfactants.

The photothermographic materials produce images by heating after imagewise exposure. In other words, black silver images are formed by heat development. It is desirable that the imagewise exposure be carried out using laser. The heating temperature suitable for heat development is from 80° C. to 250° C., preferably from 90° C. to 200° C., particularly preferably from 90° C. to 130° C. The heating time is generally from 1 second to 2 minutes.

It is desirable that the heat development be performed in the way of using a plate heater. Preferred examples of such a case are disclosed in JP-A-11-133572. More specifically, the foregoing way comprises using a heat developing apparatus which enables the conversion of latent images formed in photothermographic materials into visible images by bringing the photosensitive materials into contact with a heating means installed in the heat development section, wherein the heating means is a plate heater, a number of pressing rollers are arranged so that they are parallel to one another and opposite one surface of the plate heater and each photothermographic material is made to pass between the plate heater and the pressing rollers, thereby effecting the heat development.

Figure 2:
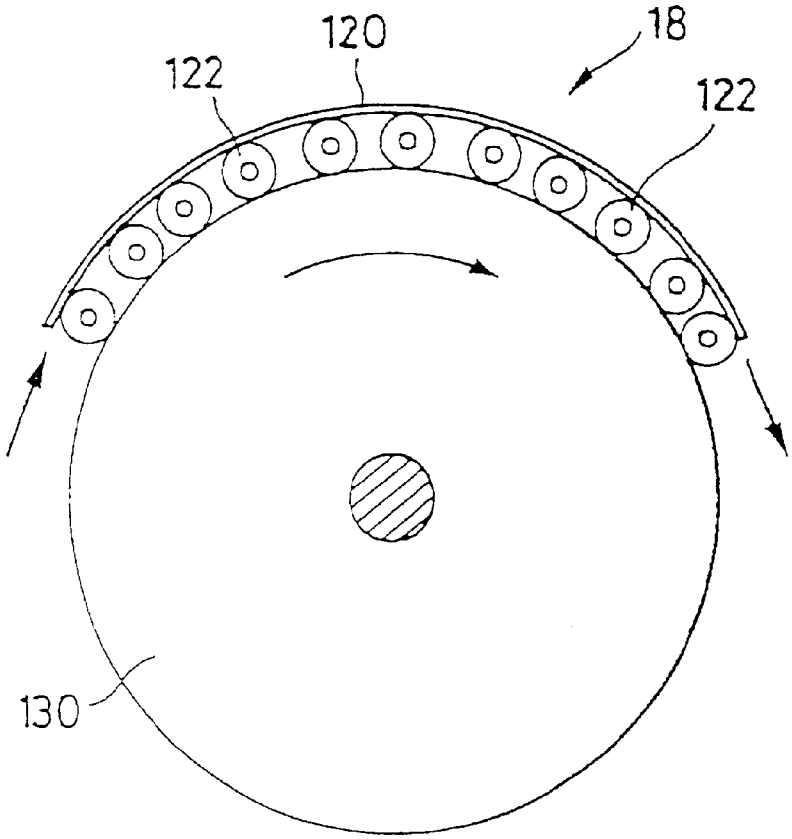
FIG. 2 is a schematic cross-sectional view of the heat development section adopting another plate heater system.

The heating system for heat-development processing has a structure as shown in, e.g., FIG. 1 or 2.

The photothermographic material conveyed into the imagewise exposure section is exposed by scanning with light beams such as laser beams carrying image data to form a latent image therein, and then conveyed by, e.g., conveying rollers, into the heat development section 18. At the time of conveyance, the dust on the front and rear sides of the photothermographic material is removed by dust removing rollers.

As shown in FIG. 1, the heat development section 18 is a region in which the photothermographic material is heated to undergo heat development, thereby converting the latent image into a visible image. The heat development apparatus used in the invention is characterized by having in the heat development section 18 a plate heater 120 and a number of pressing rollers 122 arranged so as to be opposite the plate heater 120.

The plate heater 120 is a planar heating member inside which heating elements, such as Nichrome wire, are laid on the same plane and put away therein, and maintained at the developing temperature of the photothermographic material. For the purpose of reducing the friction resistance and imparting abrasion resistance, it is desirable to coat the surface of the plate heater 120 with fluorocarbon resin or to paste a sheet of fluorocarbon resin to the surface of the plate heater 120.

Further, the vaporization of volatile components from a photothermographic material during the heating for heat development tends to cause the photosensitive material to float above the plate heater 120, thereby impairing the uniform contact between the photothermographi c material and the plate heater 120. Thus, it is also desirable to form minute roughness on the surface of plate heater 120 so as to permit the vapor to escape.

In addition, for compensating a temperature drop due to the radiation of heat at the both ends of the plate heater 120, it is desirable to provide such a temperature gradient that the temperature of the both ends is higher than that of the rest region.

The pressing rollers 122 are arranged in contact with one surface of the plate heater 120 or so as to leave a space of no greater than the thickness of a photothermographic material on the plate heater 120, and that with the stated pitch over the full length of the plate heater 120 in the direction that the photothermographic material is conveyed. The thus arranged pressing rollers 122 and plate heater 120 form a conveyance route of photothermographic materials. By leaving a space of not greater than the thickness of photothermographic materials for their conveyance route, the materials can be prevented from buckling during their conveyance. At the both ends of the conveyance route of photothermographic materials are disposed respectively a pair of feeding rollers 126 through which photothermographic materials are fed into the heat development section 18 from the direction shown by the arrow in FIG. 1 and a pair of discharging rollers 128 through which the materials after heat development are discharged in the direction shown by the arrow in FIG. 1.

Further, it is desirable for keeping the pressing rollers 122 warm to arrange a heat-retention cover 125 on the side of the pressing rollers 122 opposite to the plate heater 120.

Additionally, each photothermographic material under conveyance comes to a stop for a moment at the time when the tip thereof runs into each of the pressing rollers 122. Therefore, in a case where the pressing rollers 122 are disposed at equal intervals, the stay of the photothermographic material on pressing rollers takes place at the same areas of the material every time when the tip of the material runs into pressing rollers one after another, and thereby these areas are pressed against the plate heater 120 for a longer time than the other areas; as a result, the material generates developing streaks extending in the width direction. Such being the case, it is desirable that the pressing rollers 122 be disposed at irregular intervals.

As shown in FIG. 2, the heat development section 18 can also have a structure that the driving roller 130, whose cylindrical surface forms the envelope of the pressing rollers 122, is installed in contact with each of the pressing rollers 122 and the rotation thereof causes each pressing roller to rotate.

Additionally, the above illustration also includes a case of using a plate heater 120 constituted of a plate member made of a thermally conductive material and a heat source arranged on the side of the plate member opposite the side for heating photothermographic materials.

The present invention will now be illustrated in more detail by reference to the following examples.

EXAMPLE 1

<Preparation of Silver Halide Emulsion 1>

A solution prepared by adding 8 ml of a 1 weight % potassium bromide solute on to 1421 ml of distilled water and then adding thereto 8.2 ml of mN nitric acid and 20 g of phthalated gelatin was placed in a reaction pot made of titanium-coated stainless steel, and kept at 37° C. with stirring. Thereto, 37.04 g of silver nitrate diluted to 159 ml with distilled water (Solution A) and 32.6 g of potassium bromide diluted to 200 ml with distilled water (Solution B) were added in accordance with a controlled double jet method wherein the total amount of Solution A was added at a constant flow rate over a 1-minute period while keeping the pAg of the resultant mixture at 8.1 (by controlling the addition flow rate of Solution B) Then, the resulting reaction mixture was admixed with 30 ml of a 3.5 weight % of water solution of hydrogen peroxide, and further with 36 ml of a 3 weight % water solution of Compound 1. Further thereto, Solution A2 prepared by diluting Solution A to 317.5 ml with distilled water and Solution B2 prepared by dissolving Compound 2 (in the amount to finally make its concentration $1\times10^{-4}$ mole per mole silver) in Solution B and further diluting it to 400 ml (corresponding to twice the volume of Solution B) with distilled water were added also in accordance with a controlled double jet method wherein the total amount of Solution A2 was added at a constant flow rate over a 10-minute period while keeping the pAg of the resultant mixture at 8.1 (by controlling the addition flow rate of Solution B2). Thereafter, 50 ml of a 0.5 weight % methanol solution of Compound 3 was further added. Then, the pAg of the resulting solution was lowered to 7.5 by the addition of silver nitrate, and further the pH thereof was adjusted to 3.8 by the use of 1N sulfuric acid. At this point the reaction mixture ceased to be stirred, and it was subjected successively to precipitation, desalting and washing. Thereto were added 3.5 g of deionized gelatin and 1N sodium hydroxide, thereby adjusting the pH to 6.0 and the pAg to 8.2. Thus, a silver halide emulsion was prepared.

The grains in the thus prepared silver halide emulsion were pure silver bromide grains having an average projected area diameter of 0.053 $\mu$m and a variation coefficient of 18% with respect to the equivalent-sphere diameter. In determining such grain sizes and so on, 1,000 grains were examined with an electron microscope, and the average of their individual values was taken. The proportion of [100] surfaces in those grains was 85%, determined using the Kubelka-Munk method.

This emulsion was warmed to 47° C. with stirring, and admixed with 5 ml of a 0.5 weight % solution of Compound 4 and 5 ml of a 3.5 weight % solution of Compound 5. After one minute, Compound 6 was added thereto in an amount of $3\times10^{-5}$ mole per mole silver. After a 2-minute lapse, 0.035 g of a 3.5 weight % methanol solution of spectral sensitizing dye A was further added thereto. After a further lapse of 2 minutes, tellurium sensitizer B was added thereto in an amount of $5\times10^{-5}$ mole per mole of silver. The resulting emulsion was ripened for 90 minutes. Just before the completion of ripening, the thus ripened emulsion was admixed with $1\times10^{-3}$ mole/mole Ag of Compound 3, and cooled to 31° C. Further thereto, 5 ml of a 3.5 weight % methanol solution of Compound 7, $6.4\times10^{-3}$ mole/mole Ag of Compound 8 and $7\times10^{-3}$ mole/mole Ag of Compound 9 as a 1 weight % water solution were added successively. Thus, silver halide Emulsion 1 was obtained.

<Preparation of Silver Salt of Fatty Acid>

Behenic acid (Edenor C22-85R, trade name, a product of Henckel AG.) in an amount of 87.6 g was mixed with 423 ml of distilled water, 49.2 ml of a 5N aqueous solution of NaOH and 120 ml of tert-butanol, and stirred for one hour at 75° C. to prepare a sodium behenate solution. Separately, 206.2 ml of a water solution containing 40.4 g of silver nitrate (pH 4.0) was prepared, and kept at 10° C. The reaction vessel in which 635 ml of distilled water and 30 ml of tert-butanol were placed was kept at 30° C. with stirring, and thereto the foregoing sodium behanate solution in the total amount and the foregoing silver nitrate solution in the total amount were added over a period of 62 minutes and 10 seconds and a period of 60 minutes respectively at their individual constant flow rates. More specifically, those solutions was added in the following manner: The aqueous solution of silver nitrate alone was added for the period from the beginning of addition to a lapse of 7 minutes and 20 seconds, then the sodium behenate solution also began to be added, and further the addition of the sodium behenate solution alone was continued for a period of 9 minutes and 30 seconds after finishing the addition of aqueous silver nitrate solution. During the addition, the temperature inside the reaction vessel was maintained at 30° C. by controlling externally so that no rise in the mixed solution temperature was caused. The pipe laid for adding the sodium behenate solution was kept warm by steam trace heating, and the opening degree of steam was controlled so that the solution temperature at the exit of the addition nozzle tip was kept at 75° C. On the other hand, the pipe laid for adding the aqueous silver nitrate solution was a double pipe, and the solution temperature was kept constant by circulating cold water through the outer pipe. The nozzle tip from which the sodium behanate solution was added and that from which the aqueous silver nitrate solution was added were arranged symmetrically about the stirring axis, and situated above the reaction solution so as to avoid the contact of those nozzle tips with the reaction solution.

After the addition of the sodium behenate solution was completed, the reaction solution was stirred for 20 minutes as the temperature thereof was kept unchanged, and then cooled to 25° C. Thereafter, the solid matter in the reaction solution was filtered off with suction, and washed with water till the filtrated water came to have a conductivity of 30 $\mu$S/cm. Thus, the silver salt of fatty acid was obtained. The solid matter obtained was stored as wet cake without undergoing any drying treatment.

The form of the silver behenate grains was evaluated by electron micrography. As a result, the grains was found to have the crystal form of scales, the average projected area diameter of 0.52 $\mu$m, the average grain thickness of 0.14 $\mu$m, and the variation coefficient of 15% with respect to the average equivalent-sphere diameter.

To the wet cake in the amount corresponding to 100 g on a dry solid basis, 7.4 g of polyvinyl alcohol (PVA-205, trade name, a product of Kuraray Co. Ltd.) was added. Further, water was added thereto in the amount to adjust the total weight of the resultant mixture to 385 g, and subjected to preliminary dispersion processing with a homomixer.

The thus preliminarily dispersed solution was processed three times by using a dispersing machine, Microfluidizer M-110S-EH (trade name, a product of Microfluidex International Corporation, wherein G10Z interaction chamber was used), under the pressure adjusted to 1750 kg/cm$^2$, thereby preparing a dispersion of silver behenate. The dispersion temperature was set at the desired one by mounting coiled heat exchangers on the front and the rear of interaction chamber respectively, and controlling the temperature of the coolant used therein.

<Preparation of 25 wt % Dispersion of Reducing Agent>

Water in amount of 176 g was added to and thoroughly mixed with 80 g of 1,1-bis(2-hydroxy-3,5-dimethylphenyl)-3,5,5-trimethylhexane and 64 g of a 20 weight % water solution of modified polyvinyl alcohol, Poval MP-203 (trade name, a product of Kuraray Co., Ltd.), thereby obtaining a slurry. This slurry and 800 g of zirconia beads having an average diameter of 0.5 mm were placed together in a vessel, and underwent a dispersing operation over a period of 5 hours by means of a dispersing machine (1/4G Sand Grinder Mill, produced by Imex K. K.) to prepare a dispersion of reducing agent. The reducing agent particles present in the thus prepared dispersion had an average size of 0.72 $\mu$m.

<Preparation of 20 Weight % Dispersion of Mercapto Compound>

Water in amount of 224 g was added to and thoroughly mixed with 64 g of 3-mercapto-4-phenyl-5-heptyl-1,2,4-triazole and 32 g of a 20 weight % water solution of modified polyvinyl alcohol, Poval MP-203 (trade name, a product of Kuraray Co., Ltd.), thereby obtaining a slurry. This slurry and 800 g of zirconia beads having an average diameter of 0.5 mm were placed together in a vessel, and subjected to a dispersing operation over a period of 10 hours by the use of a dispersing machine (1/4G Sand Grinder Mill, produced by Imex K. K.) to prepare a dispersion of mercapto compound. The mercapto compound particles present in the thus prepared dispersion had an average size of 0.67 $\mu$m.

<Preparation of 30 Weight % Dispersion of Organic Polyhalogenated Compound>

Water in amount of 224 g was added to and thoroughly mixed with 48 g of tribromomethylphenylsulfone, 48 g of 3-tribromomethylsulfonyl-4-phenyl-5-tridecyl-1,2,4-triazole and 48 g of a 20 weight % water solution of modified polyvinyl alcohol, Poval MP-203 (trade name, a product of Kuraray Co., Ltd.), thereby obtaining a slurry. This slurry and 800 g of zirconia beads having an average diameter of 0.5 mm were placed together in a vessel, and subjected to a dispersing operation over a period of 5 hours by means of a dispersing machine (1/4G Sand Grinder Mill, produced by Imex K. K.) to prepare a dispersion of organic polyhalogenated compound. The polyhalogenated compound particles present in the thus prepared dispersion had an average size of 0.74 $\mu$m.

<Preparation of 10 Weight % Methanol Solution of Phthalazine Compound>

In 90 g of methanol was dissolved 10 g of 6-isopropylphthalazine.

<Preparation of 20 Weight % Dispersion of Pigment>

Water in amount of 250 g was added to and thoroughly mixed with 64 g of C.I. Pigment Blue 60 and 6.4 g of Demol (trade name, a product of Kao Corporation), thereby obtaining a slurry. This slurry and 800 g of zirconia beads having an average diameter of 0.5 mm were placed together in a vessel, and subjected to a dispersing operation over a period of 25 hours by means of a dispersing machine (1/4G Sand Grinder Mill, produced by Imex K. K.) to prepare a dispersion of pigment. The pigment particles present in the thus prepared dispersion had an average size of 0.21 $\mu$m.

<Preparation of 40 Weight % SBR Latex>

The SBR latex purified by ultrafiltration (UF) was prepared as follows: The SBR latex described below was diluted 10 times with distilled water, and purified by Module for UF purification, FS03-FC-FUY03A1 (produced by Daicen Membrane System K. K.), till the ionic conductivity was lowered to 1.5 mS/cm. Therein, the latex concentration was 40 weight %.

SBR Latex; Latex of—St(68)—Bu(29)—AA(3)

Equilibrium moisture content (25° C., 60% RH); 0.6 wt %

Average particle size; 0.1 $\mu$m

Concentration; 45 wt %

Ionic conductivity; 4.2 mS/cm

The ionic conductivity of undiluted SBR latex (40 wt %) was measured with a conductometer CM-30S (made by Toa Denpa Kogyo K. K.) at 25° C.

pH; 8.2

<Preparation of Coating Solution for Emulsion Layer (Photosensitive Layer)>

A coating solution for an emulsion layer was prepared by mixing 1.1 g of the foregoing 20 weight % pigment dispersion, 103 g of the foregoing dispersion of silver salt of organic acid, 5 g of the foregoing 20 weight % aqueous solution of polyvinyl alcohol, PVA-205 (produced by Kuraray Co., Ltd.), 25 g of the foregoing 25 weight % dispersion of reducing agent, 11.5 g of the foregoing 30 weight % dispersion of organic polyhalogenated compound, 3.1 g of the foregoing 20 weight % dispersion of mercapto compound, 106 g of a 40 weight % ultrafiltrated SBR latex and 16 ml of the foregoing 10 weight % solution of phthalazine compound, and further adding thereto 10 g of silver halide grains, followed by thorough mixing with the aforementioned ingredients. The thus prepared coating solution was coated at the coverage of 70 ml/m$^2$.

The viscosity of the thus prepared coating solution for an emulsion layer was 85 [mPa·s] at 40° C. (No.1 rotor), measured with a B-type viscometer made by Tokyo Keiki.

Further, the viscosities of the foregoing coating solution measured at 25° C. with RFS Froude Spectrometer made by Rheometrics Far East K. K. were 1,500, 220, 70, 40 and 20 [mpae·s] at the shear rates of 0.1, 1, 10, 100 and 1,000 [1/sec], respectively.

<Preparation of Coating Solution for Interlayer on Emulsion Side>

The coating solution for an interlayer was prepared by admixing 772 g of a 10 weight % water solution of polyvinyl alcohol, PVA-205 (trade name, a product of Kuraray Co., Ltd.), with 0.5 g of the foregoing 20 weight % pigment dispersion, 226 g of a 27.5 weight % latex of methyl methacrylate/styrene/2-ethylhexyl acrylate/hydroxyethyl methacrylate/acrylic acid (59/9/26/5/1 by weight) copolymer and 2 ml of a 5 weight % of water solution of Aerosol OT (produced by American Cyanamide Inc.), and applied at the coverage of 5 ml/m$^2$.

The viscosity of the thus prepared coating solution was 21 [mPa·s] at 40° C. (No.1 rotor), measured with the foregoing B-type viscometer.

<Preparation of Coating Solution for First Protective Layer on Emulsion Side>

Inert gelatin in an amount of 80 g was dissolved in water, and thereto were added 0.3 g of the foregoing 20 weight % pigment dispersion, 64 ml of a 10 weight % methanol solution of phthalic acid, 74 ml of a 10 weight % water solution of 4-methylphthalic acid, 28 ml of 1N sulfuric acid and 5 ml of a 5 weight % water solution of Aerosol OT (American Cyanamide Inc.). Further, water was added thereto in the amount to adjust the total weight of the resultant mixture to 1,000 g. The thus prepared mixture was employed as a coating solution for a first protective layer on the emulsion side, and applied at the coverage of 10 ml/m$^2$.

The viscosity of the thus prepared coating solution was 17 [mPa·s] at 40° C. (No.1 rotor), measured with the foregoing B-type viscometer.

<Preparation of Coating Solution for Second Protective Layer on Emulsion Side>

Inert gelatin in an amount of 100 g was dissolved in water, and thereto were added 20 ml of a 5 weight % solution of potassium salt of N-perfluorooctylsulfonyl-N-propylalanine, 16 ml of a 5 weight % solution of Aerosol OT (American Cyanamide Inc.), 25 g of polymethyl methacrylate fine particles (average particle size: 4.0 μm), 1.4 g of phthalic acid, 1.6 g of 4-methylphthalic acid, 44 ml of 1N sulfuric acid and 445 ml of a 4 weight % chrome alum. Further, water was added thereto in the amount to adjust the total weight of the resultant mixture to 2,000 g. The thus prepared mixture was employed as a coating solution for a second protective layer on the emulsion side, and applied at the coverage of 10 ml/m$^2$.

The viscosity of the thus prepared coating solution was 9 [mPa·s] at 40° C. (No.1 rotor), measured with the foregoing B-type viscometer.

<Production of PET Support>

PET having an intrinsic viscosity IV of 0.66 (measured at 25° C. in a phenol/tetrachloroethane (6/4 by weight) mixture) was synthesized using terephthalic acid and ethylene glycol in accordance with a conventional method. The polymer thus obtained was made into pellets, dried for 4 hours at 130° C., and molten at 300° C. The molten polymer was extruded from a T die and quenched rapidly to form an unstretched film having such a thickness as to become 175 μm after thermal fixation.

This film was stretched in the longitudinal direction with rollers differing in peripheral speed so that the length thereof was increased by 3.3 times, and then it was stretched in the transverse direction with a tenter so as to increase the width by4.5 times. These stretching operations were performed at 110° C. and 130° C. respectively. Thereafter, the thus stretched film underwent thermal fixation at 240° C. for 20 seconds, and subjected to 4 % relaxation in the transverse direction at the same temperature. Then, the film was slit along the chuck part of the tenter, underwent knurling treatment at the both edges, and wound with a draw of 4 kg/cm$^2$. Thus, a roll of film having a thickness of 175 μm was obtained.

<Surface Corona Processing>

Both sides of the support were processed at a speed of 20 m/min at room temperature by the use of a solid state corona processor, Model 6KVA (made by Pillar Co.). From the current and voltage values read off during the processing, it was found that the support had received corona discharge of 0.375 kV·A·min/m$^2$. The frequency of the corona discharge was 9.6 kHz, and the gap clearance between the electrode and the dielectric roll was 1.6 mm.

<Making of Support Provided with Subbing Layers>

Composition of Coating Solution (1) for First Subbing Layer on Both Sides:

| | |
|---|---|
| Butadiene-styrene copolymer latex (solid content: 43 wt % ; Butadiene/styrene = 32/68 by weight) | 13 ml |
| Sodium salt of 2,4-dichloro-6-hydroxy-s-triazine (8 wt % aqueous solution) | 7 ml |
| Sodium laurylbenzenesulfonate (1 wt % aqueous solution) | 1.6 ml |
| Distilled water | 80 ml |

Composition of Coating Solution (2) for Second Subbing Layer on Photosensitive Layer Side:

| | |
|---|---|
| Gelatin | 0.9 g |
| 20 wt % Pigment dispersion | 1 g |
| Methyl cellulose (Metolose SM15; substitution degree: 1.79–1.83) | 0.1 g |
| Acetic acid (concentration: 99 wt %) | 0.02 ml |
| Distilled water | 98 ml |

Composition of Coating Solution (3) for Second Subbing Layer on Back Side

| | |
|---|---|
| $SnO_2$/Sb (9/1 by weight; average grain size: 0.25 μm) | 100 mg/m$^2$ |
| Gelatin | 77 mg/m$^2$ |
| Sodium dodecylbenzenesulfonate | 1 mg/m$^2$ |
| Sodium dihexyl-α-sulfosuccinate | 4 mg/m$^2$ |

After the aforementioned corona discharge processing, the foregoing coating solution (1) was coated with a wire bar at a wet coverage of 6 ml/m$^2$ (per side) on both sides of the 175 μm-thick biaxially stretched polyethylene terephthalate film, and dried for 5 mitutes at 180° C. Subsequently thereto, one side (photosensitive layer side) of the resultant film was subjected to corona discharge, and then coated with the foregoing coating solution (2) at a wet coverage of 9 ml/m$^2$by the use of wire bar, followed by 5 minutes' drying at 180° C. Further, the other side (back side) of the resultant film was coated with the coating solution (3) at a wet coverage of 5 ml/m$^2$ by the use of wire bar, followed by 6 minutes' drying at 180° C. Thus, the support provided with subbing layers was made.

<Preparation of Coating Solutions for Back Side>

Preparation of Finely Divided Solid Dispersion of Base Precursor (a)

Distilled water in an amount of 220 ml was admixed with 64 g of a base precursor Compound (11), 28 g of a diphenylsulfone Compound (12) and 10 g of a surfactant, Demol N (trade name, a product of Kao Corporation), and subjected to beads dispersion processing by means of a sand mill (1/4 Gallon Sand Grinder Mill, produced by Imex K. K.) to prepare a finely divided solid co-dispersion of base precursor compound and diphenylsulfone compound (average particle size; 0.2 pm).

Preparation of Finely Divided Solid Dispersion of Dye

Distilled water in an amount of 305 ml was admixed with 9.6 g of a cyanine dye Compound (13) and 5.8 g of sodium p-alkylbenzenesulfonate, and subjected to beads dispersion processing by means of a sand mill (1/4 Gallon Sand Grinder Mill, produced by Imex K. K.) to prepare a finely divided solid dispersion of dye (average particle size; 0.2 $\mu$m).

Preparation of Coating Solution for Antihalation Layer

A coating solution for an antihalation layer was prepared by mixing 17 g of gelatin, 9.6 g of polyacrylamide, 70 g of the foregoing finely divided solid dispersion of base precursor (a), 56 g of the foregoing finely divided solid dispersion of dye, 1.5 g of fine polymethyl methacrylate particles (average particle size: 6.5 $\mu$m), 2.2 g of sodium polyethylenesulfonate, 0.2 g of a blue dye Compound (14) and 844 ml of water.

Preparation of Coating Solution for Back Protecting Layer

In a vessel kept at 40° C. were mixed 50 g of gelatin, 0.2 g of sodium polystyrenesulfonate, 2.4 g of N,N-ethylenebis (vinylsulfonacetamide), 1 g of sodium t-octylphenoxyethoxyethanesulfonate, 30 mg of Compound (4), 32 mg of $C_8F_{17}SO_3K$, 64 mg of $C_8F_{17}SO_2N(C_3H_7)(CH_2CH_2O)_4(CH_2)_4—SO_3Na$ and 950 ml of water to prepare a coating solution for a back protecting layer.

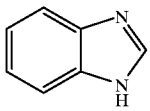

Compound (1)

$K_3IrCl_6$

Compound (2)

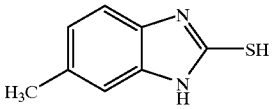

Compound (3)

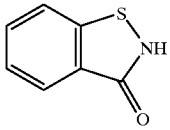

Compound (4)

-continued

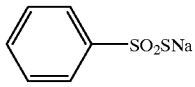

Compound (5)

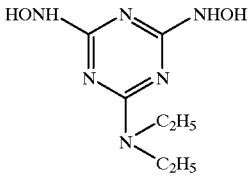

Compound (6)

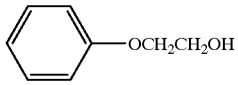

Compound (7)

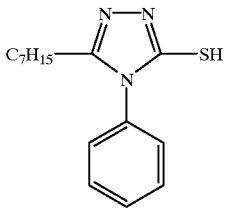

Compound (8)

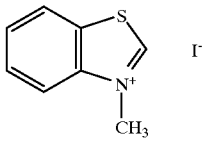

Compound (9)

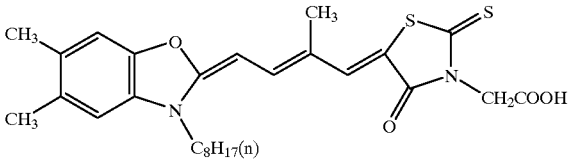

Spectral Sensitizing Dye A

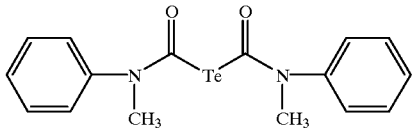

Tellurium Sensitizer B

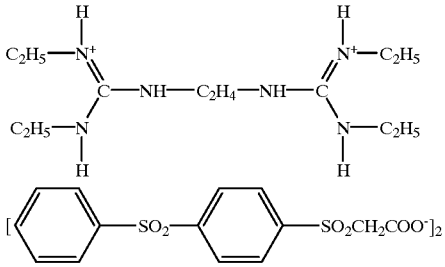

Base Precursor Compound (11)

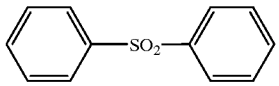

Compound (12)

-continued

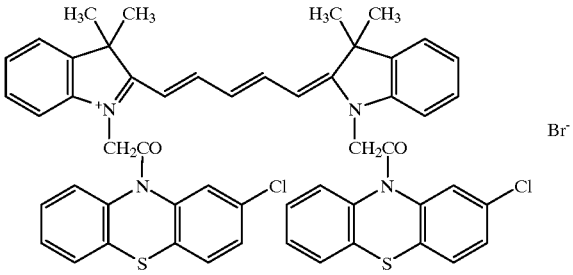

Cynaine Dye Compound (13)

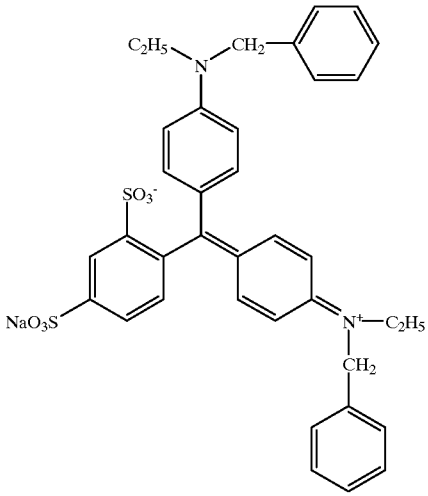

Blue Dye Compound (14)

<<Production of Photothermographic Material>>

On the back side of the forgoing polyethylene terephthalate film (support) coated with subbing layers, the coating solution for an antihalation layer and the coating solution for a back protecting layer were coated so as to have a solids coverage of 0.04 g/m$^2$ and a gelatin coverage of 1 g/m$^2$ respectively by the use of a simultaneous double coating method, and then dried to prepare an antihalation backing layer.

On the second subbing layer coated on the side opposite the back of the support, the emulsion layer, the interlayer, the first protective layer and the second protective layer were provided in this order using a slide beads technique-applied simultaneous multiple coating method, thereby producing a photothermographic material, Sample No. 101.

The coating operation was carried out at a speed of 160 m/min, the space between the tip of the coating die and the support was set at 0.18 mm, and the pressure of the vacuum chamber was controlled so as to be 392 Pa lower than atmospheric pressure. In the chilling zone subsequent to the coating zone, the air having a dry-bulb temperature of 18° C. and a wet-bulb temperature of 12° C. was made to blow for 30 seconds against the coated layers to effect the chilling. Thereafter, in the drying zone employing a helical floatation system, the air having a dry-bulb temperature of 30° C. and a wet-bulb temperature of 18° C. was made to blow for 200 seconds against the coated layers, and further these coated layers was passed through the other drying zone regulated at 70° C. over a period of 30 seconds, followed by cooling to 25° C. Thus, the solvents in the coated compositions were vaporized. Additionally, the average velocity of the air blowing against the coated layers in the chilling and drying zones was 7 m/sec.

Next, Sample Nos. 102 to 116 were produced in the same manner as Sample No. 101, except that the polymer latexes as shown in Table 1 were added in their respective amounts to the first protective layer and/or the second protective layer. Additionally, the amount of polymer latex added is represented by the content of solids therein.

Measurement of Thermal Expansion Coefficient of Each Layer

The coating solution for each layer was coated on a Teflon base so as to have a dry coverage of 25 $\mu$m, and dried at 30° C. Then, the coated film alone was peeled apart from the Teflon base to prepare a single film.

Each of the single films prepared was examined for thermal expansion coefficient using a thermal expansion coefficient measuring apparatus, TMA 2940-Thermomechanical Analyzer (made by TMA Instruments Inc.), in the atmosphere of dry nitrogen while raising the temperature from 30° C. to 120° C. The thermal expansion coefficient is expressed as follows:

Thermal expansion coefficient=Sample length at 100° C.÷sample length at 30° C.

Evaluation of Cracks

Each of the photothermographic material samples produced above was scratched on the emulsion side with a 50 g load-applied stainless stylus, the tip of which had a 0.5 mm semispherical form, while moving the stylus at a speed of 1 cm/sec in the atmosphere of 25° C.–60% RH. On the scratched surface, the kanji was drawn by scanning the laser beams obtained by using a 660 nm-light emission semiconductor laser device and longitudinal multiplication by superposing high frequency waves. Thereafter, the thus exposed samples were each developed for 20 seconds at 120° C. by means of the heat development apparatus 10 of plate heater system illustrated in Example, FIG. 1, of JP-A-11-133572, and evaluated by visual observation. Additionally, the bad odor generated during heat development was absorbed with a filter made of metallic mesh and activated carbon.

The thermal expansion coefficients of protective layers and crack evaluation of each sample are shown in Table 1. The marks employed therein have the following meanings respectively:

○: No cracks (good)

Δ: Some cracks, but on permissible level

×: Many cracks (bad)

TABLE 1

| | Kinds and Amount of Polymer Latex used and Thermal Expansion Coefficient | | | | | | |
|---|---|---|---|---|---|---|---|
| | First Protective layer | | | Second protective layer | | | |
| Sample No. | kinds | amount added* | thermal expansion coefficient** | kinds | amount added* | thermal expansion coefficient** | Cracks*** caused upon development |
| 101(comparison) | — | 0 | 0.941 | — | 0 | 0.930 | x |
| 102(invention) | E-1 | 5 | 0.971 | E-1 | 5 | 0.970 | Δ |

TABLE 1-continued

| | Kinds and Amount of Polymer Latex used and Thermal Expansion Coefficient | | | | | | |
|---|---|---|---|---|---|---|---|
| | First Protective layer | | | Second protective layer | | | |
| Sample No. | kinds | amount added* | thermal expansion coefficient** | kinds | amount added* | thermal expansion coefficient** | Cracks*** caused upon development |
| 103(invention) | E-1 | 15 | 0.978 | E-1 | 15 | 0.980 | ○ |
| 104(invention) | E-1 | 30 | 0.983 | E-1 | 30 | 0.985 | ○ |
| 105(invention) | E-1 | 45 | 0.990 | E-1 | 45 | 0.992 | ○ |
| 106(invention) | — | 0 | 0.941 | E-1 | 15 | 0.980 | Δ |
| 107(invention) | E-1 | 5 | 0.971 | — | 0 | 0.930 | Δ |
| 108(invention) | E-1 | 15 | 0.978 | — | 0 | 0.930 | ○ |
| 109(invention) | E-1 | 30 | 0.983 | — | 0 | 0.930 | ○ |
| 110(invention) | E-1 | 45 | 0.990 | — | 0 | 0.930 | ○ |
| 111(invention) | E-2 | 5 | 0.965 | — | 0 | 0.930 | Δ |
| 112(invention) | E-2 | 45 | 0.985 | — | 0 | 0.930 | ○ |
| 113(invention) | P-2 | 5 | 0.970 | — | 0 | 0.930 | ○ |
| 114(invention) | P-2 | 45 | 0.988 | — | 0 | 0.930 | ○ |
| 115(invention) | E-4 | 5 | 0.968 | — | 0 | 0.930 | Δ |
| 116(invention) | E-4 | 45 | 0.983 | — | 0 | 0.930 | ○ |

As can be seen from Table 1, the embodiments of the invention had beneficial effect on the prevention of crack generation upon heat development. In addition, every present sample had satisfactory photographic properties.

EXAMPLE 2

Samples were produced in the same manner as Sample No. 101 produced in Example 1, except that the SBR latex used in the emulsion layer was replaced by the following latex Lb1 and latex Lc1 (equilibrium moisture contents of which were both lower than 2 weight %) respectively.

Preparation of Latex Lb1

In a glass-made autoclave, TEM-V1000 (trade name, a product of Taiatu Glass Kogyo K. K.), 140 g of styrene, 280 g of distilled water, 4.44 g of a surfactant, Sandet BL (trade name, a product of Sanyo Chemical Industries, Ltd.) and 6 g of acrylic acid were placed, and stirred for one hour in a stream of nitrogen. Thereto, 54 g of 2-ethylhexyl acrylate was added, and heated up to 70° C. Then, the resultant mixture was further admixed with 20 g of a 5 weight % aqueous solution of ammonium persulfate, and stirred for 10 hours as it was. Thereafter, the temperature of the reaction vessel was cooled to room temperature, thereby obtaining a styrene-acrylic copolymer latex. The latex thus obtained was adjusted to pH 7.5 by the addition of 1N aqueous ammonia.

The thus adjusted latex (Lb1) had an average particle size of 98 nm and a concentration of 42 weight %. The copolymer therein had an equilibrium moisture content of 0.7 weight % under the condition of 25° C.–60% RH.

Preparation of Latex Lc1

In a glass-made autoclave, TEM-V1000 (trade name, a product of Taiatu Glass Kogyo K. K.), 126 g of methyl methacrylate, 280 g of distilled water, 8.2 g of a surfactant, Sandet BL (trade name, a product of Sanyo Chemical Industries, Ltd.) and 4 g of acrylic acid were placed, and stirred for one hour in a stream of nitrogen. Thereto, 70 g of ethyl acrylate was added, and heated up to 60° C. Then, the resultant mixture was further admixed with 20 g of a 5 weight % aqueous solution of potassium persulfate, and stirred for 10 hours as it was. Thereafter, the temperature of the reaction vessel was cooled to room temperature, thereby obtaining a acrylic copolymer latex. The latex thus obtained was adjusted to pH 7.5 by the addition of 1N aqueous ammonia.

The thus adjusted latex (Lc1) had an average particle size of 101 nm and a concentration of 44 weight %. The copolymer therein had an equilibrium moisture content of 0.7 weight % under the condition of 25° C.–60% RH.

The sample produced using the latex Lb1 was referred to as Sample No. 201, and the sample produced using the latex Lc1 was referred to as Sample No. 215.

Then, Sample Nos. 202 to 214 and Sample Nos. 216 to 228 were produced in the same manner as Sample No. 201 and Sample No. 215 respectively, except that the polymer latexes as shown in Tables 2 and 3 were added in their respective amounts to the first protective layer and/or the second protective layer. These samples were each evaluated by applying the same standards as in Example 1. The results obtained are shown in Tables 2 and 3.

TABLE 2

| | Kinds and Amount of Polymer Latex used and Thermal Expansion Coefficient | | | | | | | |
|---|---|---|---|---|---|---|---|---|
| | First protective layer | | | Second protective layer | | | Kinds of | |
| Sample No. | kinds | amount added* | thermal expansion coefficient** | kinds | amount added* | thermal expansion coefficient** | binder in emulsion layer | Cracks*** generated upon development |
| 201(comparison) | — | 0 | 0.930 | — | 0 | 0.941 | latex Lb1 | x |
| 202(invention) | E-1 | 6 | 0.972 | E-1 | 4 | 0.970 | latex Lb1 | Δ |
| 203(invention) | E-1 | 43 | 0.990 | E-1 | 42 | 0.988 | latex Lb1 | ○ |
| 204(invention) | E-1 | 15 | 0.980 | — | 0 | 0.941 | latex Lb1 | Δ |

TABLE 2-continued

| | Kinds and Amount of Polymer Latex used and Thermal Expansion Coefficient | | | | | | | |
|---|---|---|---|---|---|---|---|---|
| | First protective layer | | | Second protective layer | | | Kinds of | |
| Sample No. | kinds | amount added* | thermal expansion coefficient** | kinds | amount added* | thermal expansion coefficient** | binder in emulsion layer | Cracks*** generated upon development |
| 205(invention) | — | 0 | 0.930 | E-1 | 6 | 0.973 | latex Lb1 | Δ |
| 206(invention) | — | 0 | 0.930 | E-1 | 16 | 0.979 | latex Lb1 | Δ |
| 207(invention) | — | 0 | 0.930 | E-1 | 29 | 0.982 | latex Lb1 | ○ |
| 208(invention) | — | 0 | 0.930 | E-1 | 43 | 0.988 | latex Lb1 | ○ |
| 209(invention) | — | 0 | 0.930 | E-2 | 7 | 0.967 | latex Lb1 | Δ |
| 210(invention) | — | 0 | 0.930 | E-2 | 42 | 0.982 | latex Lb1 | ○ |
| 211(invention) | — | 0 | 0.930 | P-2 | 5 | 0.970 | latex Lb1 | ○ |
| 212(invention) | — | 0 | 0.930 | P-2 | 40 | 0.980 | latex Lb1 | ○ |
| 213(invention) | — | 0 | 0.930 | E-4 | 6 | 0.968 | latex Lb1 | Δ |
| 214(invention) | — | 0 | 0.930 | E-4 | 41 | 0.980 | latex Lb1 | ○ |

TABLE 3

| | Kinds and Amount of Polymer Latex used and Thermal Expansion Coefficient | | | | | | | |
|---|---|---|---|---|---|---|---|---|
| | First protective layer | | | Second protective layer | | | Kinds of | |
| Sample No. | kinds | amount added* | thermal expansion coefficient** | kinds | amount added* | thermal expansion coefficient** | binder in emulsion layer | Cracks*** generated upon development |
| 215(comparison) | — | 0 | 0.930 | — | 0 | 0.941 | latex Lc1 | x |
| 216(invention) | E-1 | 7 | 0.973 | E-1 | 6 | 0.973 | latex Lc1 | Δ |
| 217(invention) | E-1 | 42 | 0.988 | E-1 | 44 | 0.989 | latex Lc1 | ○ |
| 218(invention) | E-1 | 13 | 0.978 | — | 0 | 0.941 | latex Lc1 | Δ |
| 219(invention) | — | 0 | 0.930 | E-1 | 7 | 0.973 | latex Lc1 | Δ |
| 220(invention) | — | 0 | 0.930 | E-1 | 17 | 0.980 | latex Lc1 | Δ |
| 221(invention) | — | 0 | 0.930 | E-1 | 32 | 0.985 | latex Lc1 | ○ |
| 222(invention) | — | 0 | 0.930 | E-1 | 41 | 0.987 | latex Lc1 | ○ |
| 223(invention) | — | 0 | 0.930 | E-2 | 6 | 0.966 | latex Lc1 | Δ |
| 224(invention) | — | 0 | 0.930 | E-2 | 40 | 0.980 | latex Lc1 | ○ |
| 225(invention) | — | 0 | 0.930 | P-2 | 7 | 0.973 | latex Lc1 | ○ |
| 226(invention) | — | 0 | 0.930 | P-2 | 43 | 0.985 | latex Lb1 | ○ |
| 227(invention) | — | 0 | 0.930 | E-4 | 8 | 0.970 | latex Lc1 | Δ |
| 228(invention) | — | 0 | 0.930 | E-4 | 41 | 0.980 | latex Lc1 | ○ |

As can be seen from Tables 2 and 3, the embodiments of the invention had beneficial effect on the prevention of crack generation upon heat development. Moreover, every present sample had satisfactory photographic properties.

Additionally, the glass transition temperatures (Tg) of the polymer latexes used in the present protective layers were as follows:

E-1: 107° C.

E-2: −24° C.

P-2: 16° C.

E-4: 59° C.

In accordance with the invention, photothermographic materials can be prevented from generating cracks during heat development.

While the invention has been described in detail and with reference to specific embodiments thereof, it will be apparent to one skilled in the art that various changes and modifications can be made therein without departing from the spirit and scope thereof.

What is claimed is:

1. A photothermographic or thermographic material comprising a support having provided thereon or thereabove at least one image forming layer having its thermal expansion coefficient in the range of 1.0 to 1.5 and having provided on or above said at least one image forming layer a layer which has its thermal expansion coefficient from at least 0.9 to lower than 1.0 and comprises at least one latex polymer having a glass transition temperature of not higher than a heat development temperature, said layer which has its thermal expansion coefficient from at least 0.9 to lower than 1.0 being farther from the support than the at least one image forming layer.

2. The photothermographic or thermographic material according to claim 1, wherein the layer having its thermal expansion coefficient from at least 0.9 to lower than 1.0 is a surface protective layer.

3. The photothermographic or thermographic material according to claim 1, wherein the heat development temperature is from 90° C. to 130° C.

4. The photothermographic or thermographic material according to claim 1, wherein the latex polymer comprises repeating units derived from ethylenically unsaturated monomeric units containing an active methylene group and monomeric units containing at least two ethylenically unsaturated groups per unit.

5. The photothermographic or thermographic material according to claim 4, wherein the ethylenically unsaturated monomer containing an active methylene group is represented by formula (I):

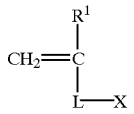

(I)

wherein $R^1$ represents a hydrogen atom, an alkyl group containing 1 to 4 carbon atoms or a halogen atom, L represents a single bond or a divalent linkage group, X represents an active methylene group selected from $R^2COCH_2COO$—, NC—$CH_2COO$—, $R^2COCH_2CO$—, NC—$CH_2CO$— or $R^9$—CO—$CH_2CON(R^6)$—, $R^2$ represents an alkyl group containing 1 to 12 carbon atoms, an aryl group containing 6 to 20 carbon atoms, an alkoxy group containing 1 to 12 carbon atoms, an amino group or a substituted amino group containing 1 to 12 carbon atoms, $R^6$ represents a hydrogen atom or an alkyl group containing 1 to 6 carbon atoms, and $R^9$ represents a primary or secondary alkyl group containing 1 to 12 carbon atoms, an alkoxy group containing 1 to 12 carbon atoms, an amino group or a substituted amino group containing 1 to 12 carbon atoms, wherein the divalent linkage group as L is bonded to X in the form of an alkylene, aralkylene or arylene moiety thereof.

6. The photothermographic or thermographic material according to claim 1, wherein the image forming layer contains at least an organic silver salt and a reducing agent.

7. The photothermographic or thermographic material according to claim 1, wherein the image forming layer comprises a photosensitive silver salt.

8. The photothermographic or thermographic material according to claim 1, wherein the image forming layer comprises a binder having an equilibrium moisture content of at most 2 weight % under a condition of 25° C.–60% RH in a proportion of at least 50 weight % to the total binders contained therein.

9. The photothermographic or thermographic material according to claim 1, wherein said image forming layer has its thermal expansion coefficient in the range of 1.1 to 1.3.

10. The photothermographic or thermographic material according to claim 1, wherein said layer having its thermal expansion coefficient from at least 0.9 to lower than 1.0 comprises, as a binder, a hydrophilic polymer having its thermal expansion coefficient from at least 0.9 to lower than 1.0.

11. The photothermographic or thermographic material according to claim 1, wherein said layer having its thermal expansion coefficient from at least 0.9 to lower than 1.0 comprises, as a binder, a hydrophilic polymer having its thermal expansion coefficient from at least 0.9 to not higher than 0.95.

12. The photothermographic or thermographic material according to claim 1, wherein said layer having its thermal expansion coefficient from at least 0.9 to lower than 1.0 comprises gelatin as a binder.

* * * * *